US009757303B2

(12) United States Patent
Marinkovic

(10) Patent No.: US 9,757,303 B2
(45) Date of Patent: Sep. 12, 2017

(54) THERAPEUTIC PILLOW

(71) Applicant: John Marinkovic, Paramus, NJ (US)

(72) Inventor: John Marinkovic, Paramus, NJ (US)

( * ) Notice: Subject to any disclaimer, the term of this patent is extended or adjusted under 35 U.S.C. 154(b) by 135 days.

(21) Appl. No.: 14/530,604

(22) Filed: Oct. 31, 2014

(65) Prior Publication Data

US 2015/0047646 A1 Feb. 19, 2015

Related U.S. Application Data

(63) Continuation-in-part of application No. 13/606,693, filed on Sep. 7, 2012, now abandoned.

(60) Provisional application No. 61/639,587, filed on Apr. 27, 2012.

(51) Int. Cl.
*A61H 1/00* (2006.01)
*A47G 9/10* (2006.01)

(52) U.S. Cl.
CPC ..... *A61H 1/008* (2013.01); *A47G 9/109* (2013.01); *A47G 9/1081* (2013.01); *A47G 2009/1018* (2013.01); *A61H 2201/1609* (2013.01); *A61H 2201/1695* (2013.01); *A61H 2203/0456* (2013.01); *A61H 2203/0475* (2013.01)

(58) Field of Classification Search
CPC ..... A47G 9/10; A47G 9/007; A47G 9/1009; A47G 2009/003; A47G 2009/1018; A47G 9/1072; A47G 9/1081; A47G 9/109; A61G 13/121; A61H 1/008
See application file for complete search history.

(56) References Cited

U.S. PATENT DOCUMENTS

| | | | | |
|---|---|---|---|---|
| 4,218,792 | A | 8/1980 | Kogan | |
| 4,447,922 | A | 5/1984 | Brochu | |
| 4,803,743 | A | 2/1989 | Greenawalt | |
| 4,821,355 | A | 4/1989 | Burkhardt | |
| 4,832,007 | A | 5/1989 | Davis et al. | |
| 5,018,231 | A * | 5/1991 | Wang | A47G 9/10 5/636 |
| 5,123,132 | A | 6/1992 | Dixon | |
| 5,471,691 | A | 12/1995 | Ryndak | |
| 5,566,682 | A | 10/1996 | Yavitz | |
| D376,288 | S | 12/1996 | Antonian | |
| D388,648 | S | 1/1998 | Bates | |
| D388,650 | S | 1/1998 | Davis | |
| 5,732,427 | A | 3/1998 | Parnham | |
| 5,797,154 | A | 8/1998 | Contreras | |

(Continued)

FOREIGN PATENT DOCUMENTS

| | | |
|---|---|---|
| CA | 241656 | 12/2004 |
| CA | 2431656 A1 | 12/2004 |

(Continued)

*Primary Examiner* — Eric Kurilla
(74) *Attorney, Agent, or Firm* — Hoxie & Associates LLC

(57) ABSTRACT

The present invention provides devices for neck support and correction, for example, pillows, headrests, or cushions, designed to be placed under the head and neck of a person lying in a supine or side-lying position. Such devices are useful for maintaining or improving cervical and/or thoracic spinal curvature and/or alignment and for reducing pain associated with ailments of the neck or cervical vertebrae. Also provided are methods of improving cervical spinal alignment and for treating or ameliorating ailments of the neck or cervical vertebrae.

7 Claims, 15 Drawing Sheets

(56) References Cited

U.S. PATENT DOCUMENTS

| | | | | |
|---|---|---|---|---|
| 5,802,644 | A * | 9/1998 | Scheurer | A47G 9/10 5/640 |
| D402,150 | S | 12/1998 | Wurmbrand et al. | |
| 5,926,879 | A | 7/1999 | Davis | |
| 5,940,913 | A | 8/1999 | Horowitz | |
| D415,920 | S | 11/1999 | Denney | |
| 6,006,380 | A | 12/1999 | Sramek | |
| 6,079,066 | A | 6/2000 | Backlund | |
| 6,132,004 | A | 10/2000 | Carlino | |
| D444,980 | S | 7/2001 | Mowat et al. | |
| 6,345,401 | B1 | 2/2002 | Frydman | |
| 6,381,784 | B1 | 5/2002 | Davis et al. | |
| 6,471,726 | B2 | 10/2002 | Wang | |
| 6,513,179 | B1 | 2/2003 | Pan | |
| 6,574,809 | B1 | 6/2003 | Rathbun | |
| 6,671,906 | B1 | 1/2004 | Milligan | |
| 6,751,818 | B2 | 6/2004 | Troop | |
| 6,817,049 | B1 | 11/2004 | Hall | |
| 6,823,546 | B1 | 11/2004 | Hsu | |
| 6,915,539 | B2 | 7/2005 | Rathbun | |
| 6,981,288 | B1 | 1/2006 | Hu | |
| 7,013,512 | B1 | 3/2006 | Shu | |
| 7,082,633 | B1 | 8/2006 | Maarbjerg | |
| 7,203,983 | B1 | 4/2007 | Reeves et al. | |
| 7,210,178 | B2 | 5/2007 | DiGirolamo | |
| 7,516,504 | B2 | 4/2009 | Guez | |
| 7,681,262 | B2 | 3/2010 | Weedling et al. | |
| 8,065,766 | B1 | 11/2011 | Fierro | |
| 8,359,686 | B2 | 1/2013 | Hunter et al. | |
| 2002/0184707 | A1 | 12/2002 | Stevens | |
| 2005/0050636 | A1 | 3/2005 | Setokawa | |
| 2005/0223493 | A1 | 10/2005 | Setokawa et al. | |
| 2006/0048300 | A1 * | 3/2006 | DiGirolamo | A47G 9/10 5/645 |
| 2008/0134439 | A1 | 6/2008 | Ricalde | |
| 2009/0025145 | A1 | 1/2009 | Tuffin et al. | |
| 2011/0094033 | A1 | 4/2011 | Lee | |
| 2011/0131728 | A1 | 6/2011 | Rose et al. | |
| 2011/0185505 | A1 | 8/2011 | Davis | |
| 2011/0231999 | A1 | 9/2011 | Yang | |
| 2012/0073056 | A1 | 3/2012 | Freund | |
| 2013/0283534 | A1 | 10/2013 | Marinkovic | |

FOREIGN PATENT DOCUMENTS

| | | |
|---|---|---|
| FR | 2821733 | 9/2002 |
| RU | 56142 | 9/2006 |
| WO | WO 98/07358 | 2/1998 |
| WO | WO 2005/032309 | 4/2005 |

* cited by examiner

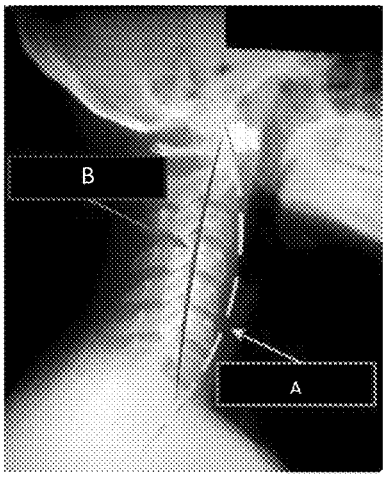
Fig. 28-A
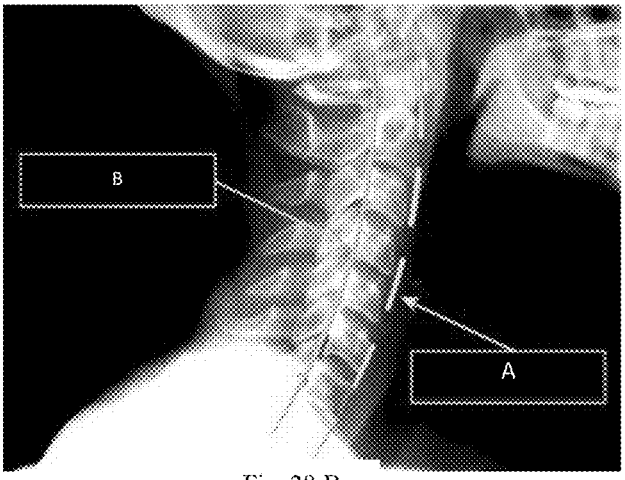
Fig. 28-B
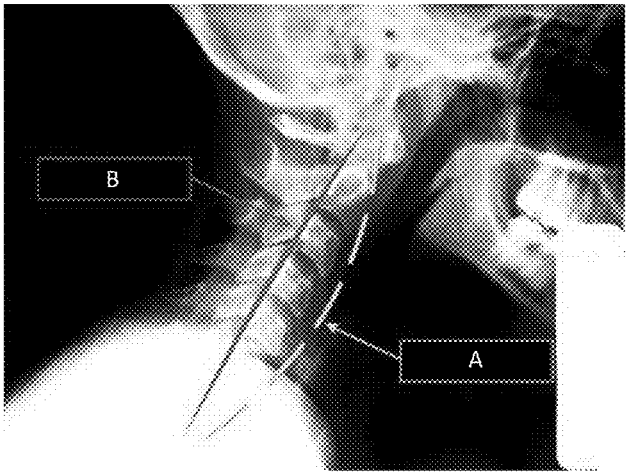
Fig. 28-C

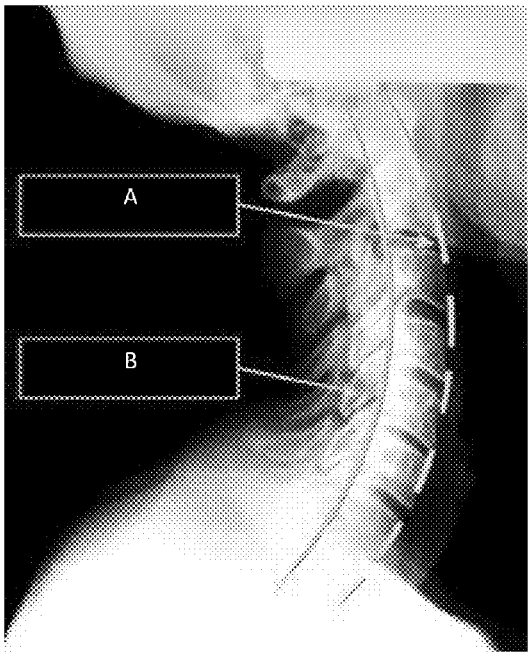
Fig. 29-A
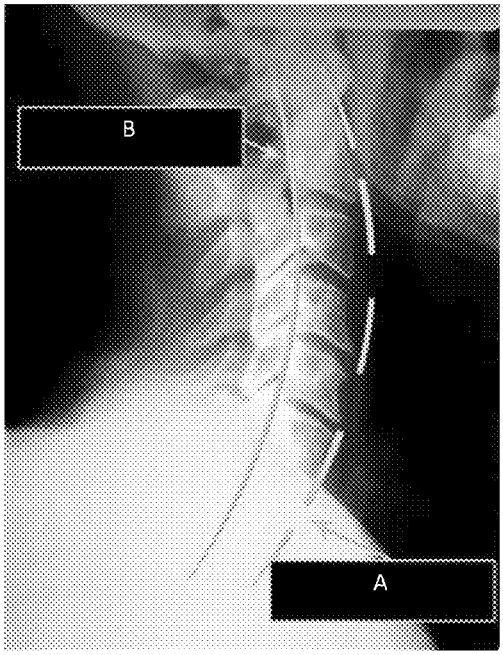
Fig. 29-B
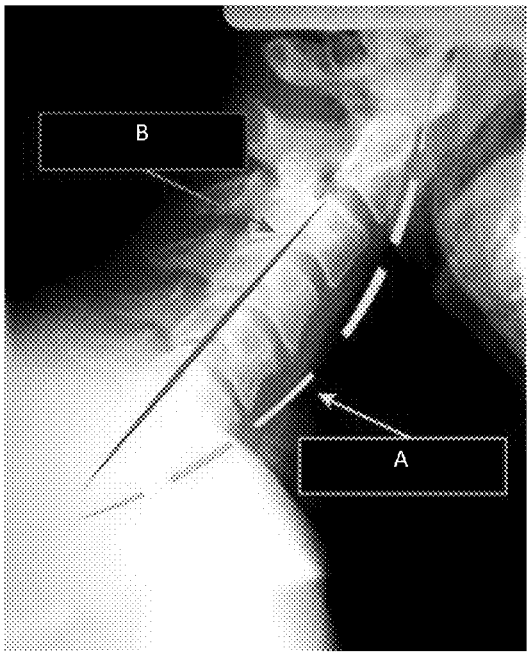
Fig. 29-C

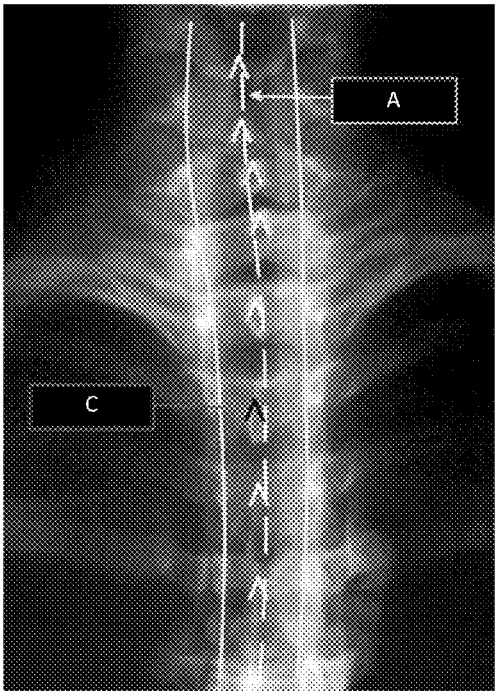
Fig. 30-A
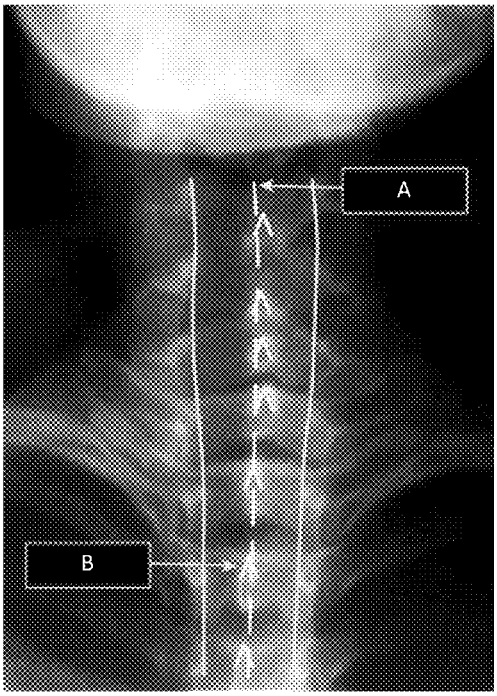
Fig. 30-B
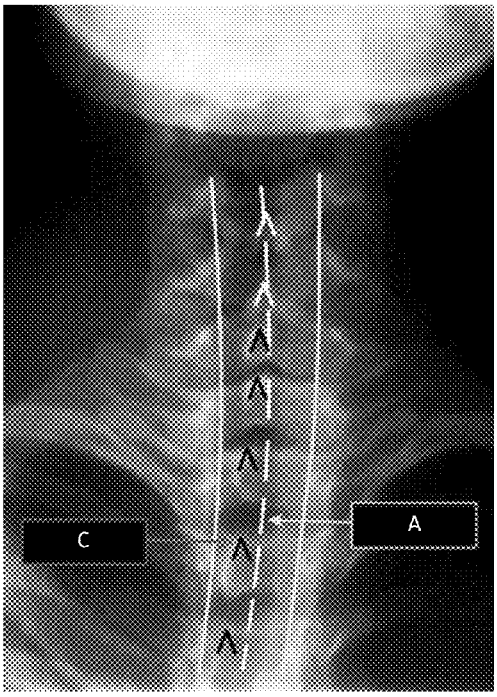
Fig. 30-C

THERAPEUTIC PILLOW

CROSS REFERENCE TO RELATED APPLICATION

This application is a continuation-in-part of U.S. patent application Ser. No. 13/606,693, filed on Sep. 7, 2012, which claims priority to U.S. patent application Ser. No. 61/639,587, filed on Apr. 27, 2012, is the contents of which are hereby incorporated by reference in their entirety.

TECHNICAL FIELD

This invention relates to devices for neck support and correction, for example, pillows, headrests, or cushions and more particularly, to custom, therapeutic pillows or cushions, designed to be placed under the head and neck of a person lying in a supine or side-lying position, and methods involving the use thereof.

BACKGROUND

Because approximately one-third of all human existence is spent in a supine position, there has been great interest in developing pillows or cushions that properly support a person's body in such position. Some pillows are marketed as being posture or cervical pillows that are designed to support the head and spine, and in particular, the neck vertebrae, in the most normal, comfortable and unstressed position, thereby aiding in relieving stress in the cervical or neck portion of the upper spine, and for promoting proper posture.

The neck of a person lying in a supine or side-lying position is often out of alignment with the person's spine. This may be especially true when using either standard or contoured commercial pillows. This is commonly the case when the person's neck is supported by a pillow or multiple pillows such that the neck lies at an angle defined by the deflected height of the pillow(s) and this angle is typically not co-planar with the spine. The deflected height of the pillow is closely related to its stiffness, which is conventionally provided by filling material disposed within a fabric covering. Conventional filling material includes feathers, cotton, and synthetic fillers.

Recently, a number of pillows have been formed of viscoelastic material, such as a viscoelastic foam material. These types of pillows are often referred to as memory foam pillows. The viscoelastic foam responds to changes in temperature such that body heat molds the pillow to conform to the curves of a body for comfort and support. This allows the shape of the pillow to more closely follow the contours of the body and to promote an improved alignment of the neck and spine when a person is in a supine or side-lying position.

While currently available pillows provide comfort and some therapeutic effect, they often do not promote optimal alignment of the neck and spine. Indeed, many currently available pillows promote the misalignment of the neck and spine in otherwise healthy users. Therefore, there is a need to provide improved pillows and other neck support devices that are not only comfortable, but also provide a therapeutic effect and promote improved alignment of the neck and spine when a person is seated, or in a supine or side-lying position.

BRIEF SUMMARY

The present disclosure provides several therapeutic pillows and other neck-supporting devices, as well as methods of using the same to maintain or improve the alignment of the cervical and/or thoracic vertebrae of users. According to one embodiment of the present disclosure, a back-sleeper pillow 200 is provided as shown in FIGS. 6-9 for use in a supine sleeping position. This pillow is formed of a foam body that has a top surface, an opposing bottom surface, a rear edge and an opposing front edge and lateral sides. The foam body is defined by a first region that includes the front edge, a second region adjacent the first region and a third region adjacent the second region and defining the rear edge. The first region has a convex shape, the second region has a concave shape and the third region has a convex shape. The pillow has a maximum thickness in the first region and a minimum thickness in the second region.

The first region has a first section that extends to the front edge and has a positive slope (convex increasing section) and has an adjacent second section that has a negative slope (convex decreasing section). The pillow also includes a plurality of ribs extending longitudinally between the lateral side and being located exclusively within the first section of the first region. In contrast, the second section of the first region is free of ribs.

The present disclosure further provides a side-sleeper pillow 600, as shown in FIGS. 16-21, for use in a side-lying position. This pillow is formed of a foam body that has a top surface, an opposing bottom surface, a rear edge and an opposing front edge and lateral sides. The foam body has a step configuration with maximum thickness at the front edge and minimum thickness at the rear edge. The front edge includes cut-outs designed to receive the user's shoulder.

The present disclosure further provides a combination pillow 800, as shown in FIGS. 22-27, for use in either a supine position (back-sleeping) or a side-lying position (side-sleeping). Said pillow is formed of a foam body having a top surface, an opposing bottom surface, a rear edge, an opposing front edge and lateral sides. The foam body is defined by a first section constructed for use when a user is in the supine sleeping position and at least one adjacent second section for use when the user is in the side-lying position. In a further embodiment, the foam body consists of three adjacent sections, wherein the middle section is a supine sleeping section and the outer adjacent sections are both side-sleeping sections.

The back-sleeping section of the pillow 800 includes a first region, a second region adjacent the first region and a third region adjacent the second region. The first region includes the front edge and the third region includes the rear edge. The first region has a convex shape, the second region has a concave shape and the third region has a convex shape. The first region has a first section that extends to the front edge and has a positive slope and an adjacent second section that has a negative slope. The first pillow section also includes a plurality of ribs extending longitudinally between the lateral side and being located exclusively within the first section of the first region. The second section of the first region is thus free of ribs.

The side-sleeping section or sections of the pillow 800 have a step configuration with maximum thickness at the front edge and minimum thickness at the rear edge. The front edge includes cut-outs designed to receive the user's shoulder. The top surface of the side-sleeping sections are elevated relative to the top surface of the back-sleeping section.

In another aspect, the present disclosure provides a method of maintaining or improving the alignment of the cervical vertebrae in a person (either a healthy person or a patient in need of improved alignment), the method comprising sleeping with the head and neck supported by any of the aforementioned pillows of the present disclosure. Such a method may ameliorate many of the adverse symptoms associated with neck or spine related ailments in said patients.

Other aspects, features and advantages of the invention will be apparent in view of the accompanying description of certain embodiments thereof when considered in connection with the accompanying drawing figures.

BRIEF DESCRIPTION OF THE DRAWINGS

FIGS. 28-A, 28-B and 28-C are X-ray imaging studies of a patient with abnormal cervical curvature using Pillow 200;

FIGS. 29-A, 29-B and 29-C are X-ray imaging studies of a patient with normal cervical curvature using Pillow 200;

FIGS. 30-A, 30-B, and 30-C are X-ray imaging studies of a patient with abnormal thoracic alignment using Pillow 600.

DETAILED DESCRIPTION

Figure 1:
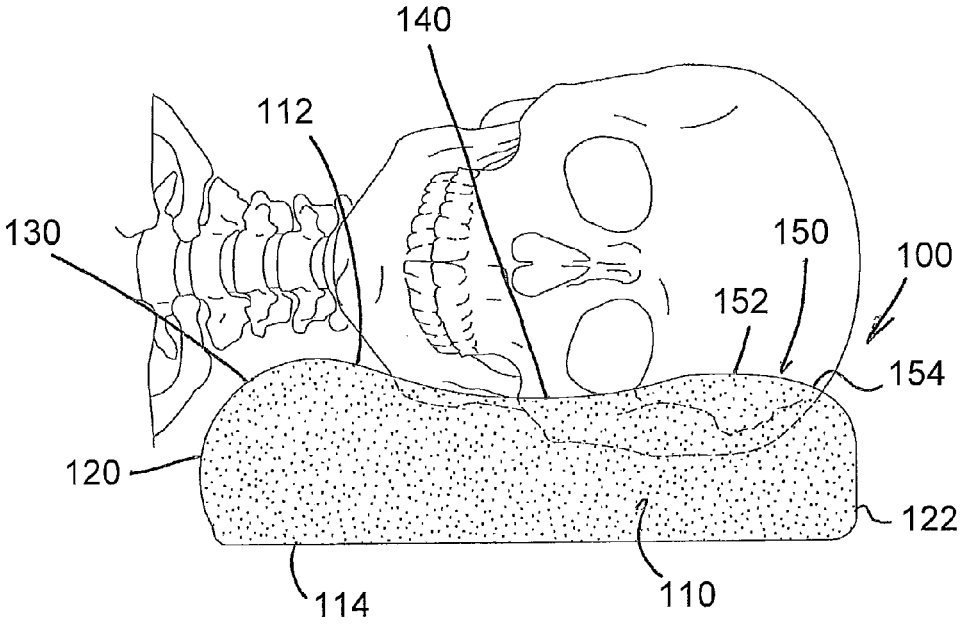
FIG. 1 is a side elevation view of a pillow according to a first embodiment in use in a first sleep position.
Figure 2:
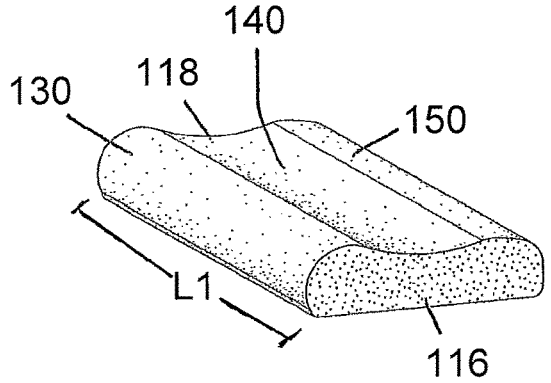
FIG. 2 is a perspective view thereof.

In general, the present disclosure provides an orthopedic (therapeutic) pillow having advantages over other such pillows known and used in the art. Past orthopedic pillows often have a peanut shape or other such configuration that, for a majority of people, is either uncomfortable or not therapeutic. While sleeping on one's side, such prior art pillows typically cause the neck to arch over excessively laterally. This creates a pressure on the small joints in the cervical spine known as the uncinate processes. This can cause the user to awaken with neck pain and muscle spasms and may even lead to osteoarthritis of these joints over time. Also, while lying supine, the shape of such prior art pillows often causes a forward protrusion of the head that can create an anterior weight bearing posture in the user, shortening the anterior cervical spine musculature and increasing the curve in the thoracic and lumbar spine, thereby resulting in hyper-kyphosis (increased convexity of the thoracic spine) or hyper-lordosis (increased anterior concavity of the lumbar and cervical spine). Such poor posture over time can lead to a variety of musculoskeletal problems with such symptoms as headaches, neck and/or back pain, numbness or tingling in arms or hands, etc. The poor spinal positioning and resulting poor posture caused by many prior art pillows can also irritate pre-existing problems such as arthritis and disc syndromes. Since the average person spends approximately one third of his or her life in a sleeping position and during sleep the human body repairs, it is important to be in a biomechanical position that will accommodate and enhance this process. The pillows that are the subject of the present disclosure fulfill these needs and yield further advantages, as described below, by generally providing an improved ergonomic design that promotes improved alignment of the neck and spine when a person is in a supine or side-lying position.

FIGS. 1-5 illustrate a pillow 100 according to a first embodiment of the present disclosure and designed to promote improved alignment of the neck and spine when a person is in a side-lying position. As described below, the pillow 100 has a specific shape and contours to achieve this objective.

In one embodiment, the pillow 100 is formed of a viscoelastic material, such as a viscoelastic foam, which possess specific thermally responsive properties which cause the pillow 100 to conform to the shape of the portion of a person's body that contacts the pillow. The viscoelastic foam has a lower stiffness or hardness at an elevated temperature as compared to the stiffness at a cooler temperature. Conversely, conventional pillow filler materials typically have a constant stiffness with respect to a changing temperature. The body heat of the person acts to soften the portion of the pillow 100 in contact with the body, while the portion of the pillow 100 not contacting the body remains more firm. As a result, the pillow 100 allows for a greater comfort over a conventional pillow by accommodating each user's body form.

Any number of different viscoelastic foam materials are commercially available and can be selected for use in the present disclosure so long as they are suitable for the intended application and use as a pillow material. Preferably, the viscoelastic foam is a polyurethane foam. Generally, there are several important considerations when shopping for a memory foam product, such as the pillow of the present disclosure. Two of the main factors are the thickness and density. Memory foam comes in densities ranging from 1 to 5 pounds per cubic foot. Foam density of 5 pounds (lbs) per cubic foot (80 kg/m$^3$) or greater is considered high quality, although most standard memory foam has a density of about 1 to 5 lb/ft$^3$ (16-80 kg/m$^3$). In addition, most bedding, such as topper pads and comfort layers in mattresses and pillows, have a foam density of between about 3 to 4.5 lb/ft$^3$. Very high densities, such as 5.3 lb/ft$^3$ (85 kg/m$^3$), are used infrequently in mattresses. The pillows of the present disclosure can be formed of materials that have densities from about 1 to about 5 lbs/ft$^3$, for example about 3 to 5 lbs/ft$^3$; about 4 to 5 lbs/ft$^3$; about 3 to 4.5 lbs/ft$^3$; or about 4 to 4.5 lbs/ft$^3$, etc. More preferably, the viscoelastic foam of the present disclosure has an average density of about 3.5-4.5 lbs/ft$^3$.

In addition to the foam density, another important aspect of viscoelastic foam is its resiliency or compressibility. This is commonly measured by the 25% Indentation Foam Deflection test (IFD test, see ASTM D3574). This test, also known as the indentation load deflection test, consists of measuring the number of pounds of force it takes to compress the foam by 25% of its original thickness. 25% IFD is a measure of surface firmness. The related 65% IFD test measures the force needed to compress foam by 65% of its original thickness, and this is a measure of deep firmness. In a preferred embodiment of the present disclosure, the viscoelastic foam has a 25% IFD of 8-20 lbs, more preferably 11-17 lbs. Another useful test is the Ball Rebound Test (BRT), which involves dropping a steel ball onto foam from a fixed height and measuring the rebound height of the ball as a percentage of its initial height. In a preferred embodiment, the viscoelastic foam of the present disclosure has a resiliency as measured by the BRT of about 40 to 75%, more preferably about 50 to 65%.

For some bedding, memory foam typically comes in slab form from which products, such as a mattress component, can be made and the slabs can have different thicknesses, typically in various thicknesses ranging from about 1 inch to about 5 inches. However, these are merely exemplary dimensions and properties and are not limiting of the present disclosure.

Viscoelastic foam products can be formed using any number of different processes including but not limited to pouring the liquid foam into a mold or the like to form a block which is then removed from the mold when cooled. More advanced technology creates the viscoelastic foam in a vacuum chamber. Called vacuum injection, this process of manufacturing creates a foam product of uniform density and ultimately, a high quality mattress topper, pad, or pillow. Various finishing techniques can be used to form the viscoelastic product having the desired shape and in particular, various cutting techniques (e.g., a laser cut) can be used to transform the block of viscoelastic material into the end-use product.

The pillow 100 of FIGS. 1-5 is formed of a body 110 (such as a viscoelastic foam body) that is defined by a top surface 112 on which the user's body rests; an opposite bottom surface 114, a first side 116, an opposite second side 118, a front 120 and an opposite rear 122. The pillow 100 has a length L1 and a width W1 and a variable thickness T1 across the width W1 of the pillow 100 as described below.

The pillow 100 is formed such that is has several distinct regions that are designed to contact and support the neck (spine) and head of the user. More specifically, the pillow 100 has a first region 130 formed along the front 120 of the pillow 100, a second region 140 formed centrally, and a third region 150 formed along the rear 122 of the pillow 100. The second region 140 is thus located between the first region 130 and the third region 150.

Figure 3:
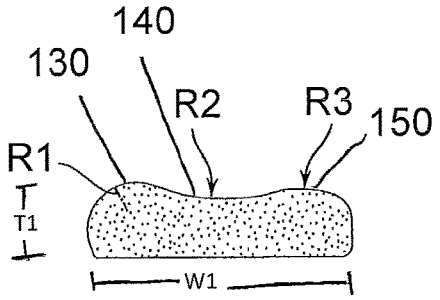
FIG. 3 is a side elevation view thereof.
Figure 4:
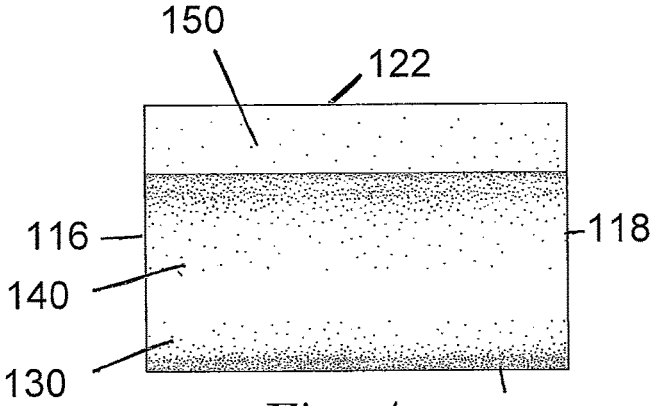
FIG. 4 is a top plan view thereof.
Figure 5:
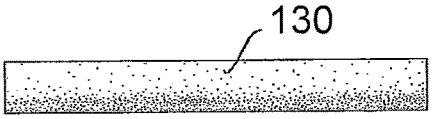
FIG. 5 is a front elevation view thereof.
Figure 6:
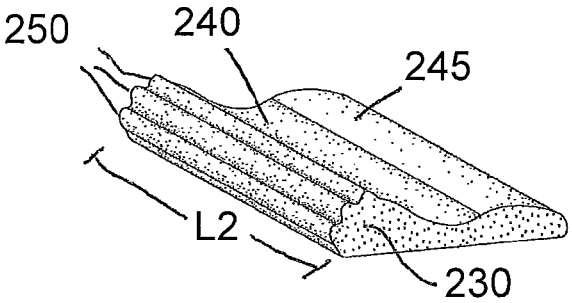
FIG. 6 is a perspective view of a pillow according to a second embodiment in use in a second sleep position.
Figure 8:
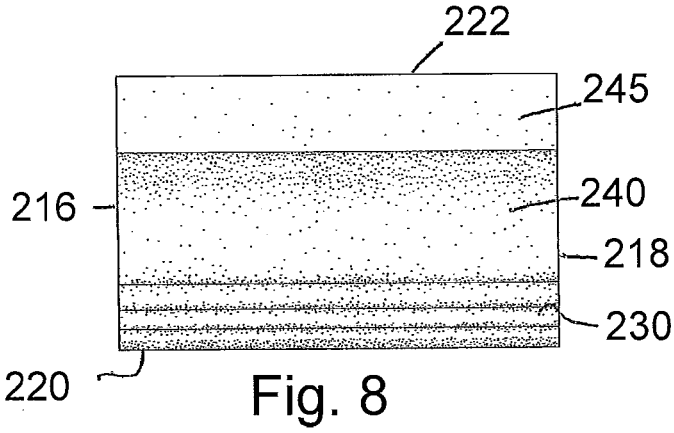
FIG. 8 is a top plan view thereof.
Figure 9:
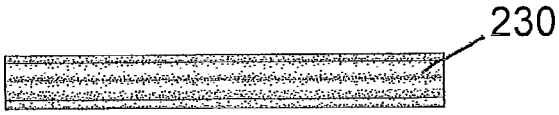
FIG. 9 is a front elevation view thereof.

As can be seen from FIGS. 1-5, the first region 130 and the third region 150 are both generally convex shaped regions, while the center second region 140 is concave in nature. As best shown in FIG. 3, the top surface of the pillow thus transitions from a convex surface of the first region 130 to a concave surface of the second region 140 before again transitioning to the convex surface of the third region 150. It will be appreciated that, as shown, the first region 130 has a more pronounced curvature compared to the third region 150 which is defined by a slight curvature. The curvature in the third region 150 can be so slight that a portion thereof has almost a flat appearance before the pillow has more pronounced curvature at the rear edge 122 of the pillow. In other words, the third region 150 can be defined by a complex curvature in that it can include a first section 152 that extends from a transition between the second region 140 and the third region 150 to a first point and a second section 154 that extends from the first point to the rear edge 122 of the pillow 100. The radius of curvature in the first section 152 is different than the radius of curvature in the second section 154 since as can be readily seen in FIG. 3, the curvature in the second section 154 is much more pronounced.

The convex first region 130 is defined by a first radius of curvature R1; the concave second region 140 is defined by a second radius of curvature R2; and similarly, the convex third region 150 is defined at least in part by a third radius of curvature R3. It will be appreciated that the transition points between the adjacent convex and concave regions can be defined by inflection points. In particular, the first region 130 which has a convex shape can be thought of as having a convex increasing (positive slope) section and a convex decreasing (negative slope) section and similarly, the second region can be thought of as having a concave increasing (positive slope) section and a concave decreasing (negative slope) section. The same is true of the third region 130 in that it can include a convex increasing (positive slope) section and a convex decreasing (negative slope) section.

The first region (roll portion) 130 is formed integral with the other regions such that its highest aspect is vertically higher than the top surface of the other two regions, namely, the second and third regions 140, 150, respectively. In other words, the thickness of the pillow 100 is greatest in the first region 130 (e.g., a roll portion) compared to both the second region 140 and the third region 150 and is at a minimum in the second region 140.

When the user is in a side-lying position as shown in FIG. 1, the neck 20 and head 30 of a user 10 are maintained in a substantially straight posture as supported by the first region (roll portion) 130 and the second and third regions 140, 150, respectively. More specifically, the neck 20 contacts and is supported by the first region 130 and this provides the proper alignment of the neck and spine.

The width W1 of the pillow 100 is constructed such that for many or most patients, the top of the head 30 extends to and at least partially seats in the first section 152 of the third region 150 when the user is in a side-lying position as shown in FIG. 1. However, it will be appreciated that a user's head 30 may be entirely contained within and in contact with the second region 140.

In one embodiment, for an adult pillow, the pillow has a length L1 of about 20.00 inches; a width W1 of about 12.55 inches; and a maximum thickness of about 3.57 inches as measured in the first region 130 (which is the thickest part of the pillow 100). The first region 130 can be defined by a first radius of curvature (R1) of 2.30 inches; the second region 140 can be defined by a second radius of curvature (R2) of 9.12 inches and the third region 150 can be defined by a third radius of curvature (R3) of 6.69 inches. As mentioned above, the third region 150 can be modified so as include a flat or a section of reduced curvature relative to adjacent sections. It will be appreciated that the above dimensions are merely exemplary in nature and do not limit the scope of the present disclosure. The present disclosure also includes like pillows of similar proportions for use by children.

It has been found that the construction of pillow 100 provides greater comfort and therapeutic effect as a result of the curvature of the first region 130 for supporting the neck in an optimal manner resulting in a neutral spine position being obtained when the user is in the side-lying position.

In a second embodiment, the present disclosure provides a pillow 200, as shown in FIGS. 6-9. Pillow 200 is specifically constructed to promote improved alignment of the neck and spine when a person is in a supine position.

The pillow 200 of FIGS. 6-9 is formed of a body 210 (such as a viscoelastic foam body) that is defined by a top surface 212 on which the user's body rests; an opposite bottom surface 214, a first side 216, an opposite second side 218, a front 220 and an opposite rear 222. The pillow 200 has a length L2 and a width W2 and a variable thickness T2 across the width W2 of the pillow 200 as described below.

The pillow 200 is formed such that is has several distinct regions that are designed to contact and support the neck (spine) and head of the user. More specifically, the pillow 200 has a first region 230 formed along the front 220 of the pillow 200, a second region 240 formed centrally, and a third region 245 formed along the rear 222 of the pillow 200. The second region 240 is thus located between the first region 230 and the third region 250.

Figure 7:
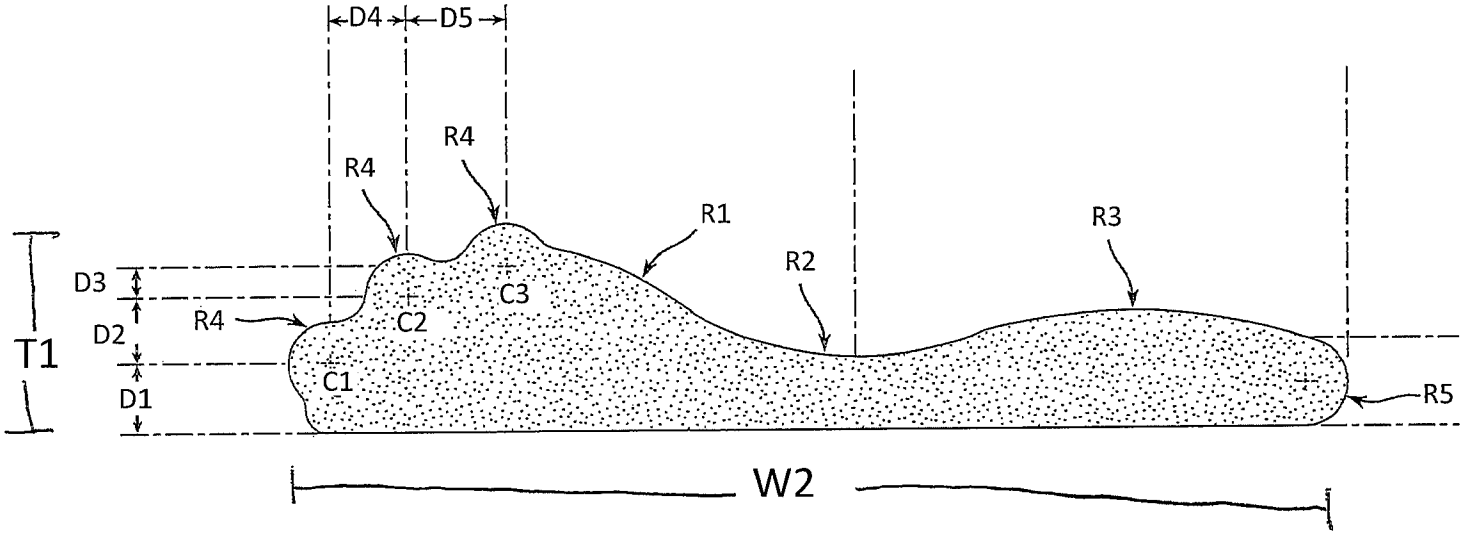
FIG. 7 is a side elevation view thereof.
Figure 10:
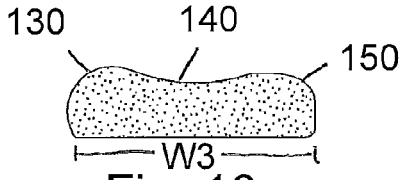
FIG. 10 is a side elevation view of a pillow according to a third embodiment.

As can be seen from FIGS. 6-9, the first region 230 and the third region 245 are both generally convex shaped regions, while the center second region 240 is concave in nature. As best shown in FIG. 7, the top surface of the pillow thus transitions from a convex surface of the first region 230 to a concave surface of the second region 240 before again transitioning to the convex surface of the third region 250. It will be appreciated that, as shown, the first region 230 has a more pronounced curvature compared to the third region 245 which is defined by a slight curvature.

Both the front 220 and rear 222 of the pillow are defined by rounded edges. While the first region 230 has a generally cylindrical shape (roll portion) it is further defined by a plurality of ribs 250 that are strategically placed along the convex shaped first region 230. In particular, the first region 230 can be thought of as being defined by a first section that extends from the front 220 to an apex (maximum) point at which point the slope of the curve changes. A second section of the first region 230 extends from the apex point to a transition (inflection) point that marks the beginning of the concave shaped second region 240. In other words and as shown, the first section can be thought as being an upwardly sloped section (convex increasing) of the convex shaped first region 230, while the second section can be thought of as being a downwardly sloped section (convex decreasing) of the convex shaped first region 230.

In one embodiment, as shown in FIG. 7, there are, for example, three ribs 250 that are located along the first region 230 and in particular, are located along the first section (convex increasing section) thereof. In other embodiments, there may be two, four, five or six ribs. In some embodiments, the ribs 250 are entirely contained within the first section and are not disposed within the second section (convex decreasing). In other words, the ribs 250 are located entirely along the upwardly sloped portion (convex increasing) of the convex shaped first region 230 and are not present and located along the second section. In other embodiments, the ribs may be located on both the upwardly sloped and downwardly sloped portions of the convex first region 230. The present applicant has found, as discussed in greater detail below, that the position of spaced apart ribs 250 on the upwardly slope portion of the convex region (roll portion) 230, with the downwardly sloped portion thereof being free of ribs, results in a more comfortable pillow that is also therapeutic in that the strategic positioning of the ribs 250 promotes improved alignment of the neck and spine for reasons discussed below.

As a result, in one embodiment, the second section (convex decreasing) does not include any ribs 250; however, it is within the scope of the present disclosure that some type of rib structure could be placed along the second section.

Cervical lordosis is a curve in the cervical spine, the area of the spine which contains the neck vertebrae. This curve is entirely normal and in fact desirable because it helps to stabilize the head and spine, but when the curve straightens out, becomes too deep, or faces in the wrong direction, it can become a problem. There are several treatments available for loss of cervical lordosis, with treatment being supervised by a medical professional who specializes in spinal care.

The normal cervical lordosis (which extends from C1 to T2) should have a 17-24 centimeter radius. This is easily measured with the AcuArc ruler which is one of the commonly used techniques to measure the curvature of the cervical spine.

In an optimal cervical lordosis condition, all segments should be on Georges's line (posterior body line) which is a curved line that should touch the posterior body margin of all of the segments of the spine in any of the three main curvatures. There should be an even spacing between each spinous process. Positioning of the head and spine should also be assessed for anterior head placement (also known as Forward Head Posture). The atlas is the topmost cervical vertebra (C1). The posterior arch of atlas should be centered in the space between the occiput and the C2 spinous process. If C1's posterior arch "crowds" the occiput, it is labelled as an "inferior" atlas. If it crowds C2, it is labelled as a "superior" atlas. The normal atlas plane line would be 18-24 degrees superior to the bottom of the film. A line under the bottom of the C2 body (Whitehorn's line) should be parallel with the floor.

The structure of the pillow 200 allows the head 30 to arch back over the cylindrical shaped roll portion (first region 230) of the pillow and be supported by the center second section (second region 240) of the pillow 200.

There are a plurality of ribs 250. Each rib 250 is a curved structure and as illustrated, each rib 250 has a convex shape. The ribs 250 are spaced from one another such that the regions between two adjacent ribs 250 represent a valley that has a concave curvature. The ribs 250 can thus be defined by a radius of curvature (R4). The ribs 250 can be formed, as shown, such that they are uniform in that the radius of curvature (R4) of each of the ribs 250 is substantially equal.

In one embodiment, the first region 230 is defined by a first radius of curvature (R1) having a value of about 3.944 inches and each of the ribs 250 has a fourth radius of curvature (R4) of about 0.500 inch. However these values are merely exemplary in nature and not limiting of the present disclosure and other values can be selected and used. The concave second region 240 is defined by a second radius of curvature (R2) having a value of about 3.927 inches. One will thus appreciate that the values of the radii of curvature of the first and second regions 230 and 240 are very similar with the second region 240 only being slightly less. This is in contrast to the third region 245 which does not have as pronounced a curvature and in the illustrated embodiment is defined at least in part by a third radius of curvature (R3) of 6.693 inches. The rear 222 can be defined by a fifth radius of curvature (R5) which can be about 0.500 inch in one embodiment. The curvature R1 is much more pronounced than R3.

As shown in FIG. 7, the spacing between the ribs 250 does not have to be uniform in that the distance between the center points (C1, C2, C3) of the circles that define the radii of curvature of the ribs 250 can be different between the forward rib 251 (associated with center point C1) and a center rib 253 (associated with center point C2) as compared to the center rib 253 and a rear rib 255 (associated with center point C3). For example, the distance (D4) between the forward rib 251 and the center rib 253 can be about 0.917 inch, while the distance (D5) from the center rib 253 to the rear rib 255 can be about 1.147 inch (as measured along the width of the pillow (i.e., front to rear measurement)). The center points C1, C2, C3 are thus at different heights relative to a ground surface on which the bottom 214 of the pillow seats. In the illustrated embodiment, the distance (D1) from point C1 to the ground surface is about 0.795 inch, while the distance (D2) from point C2 to the ground surface is about 1.586 inch (distance between C1 and C2 being about 0.791 inch) and the distance (D3) from point C3 to the ground surface is about 1.941 inch (distance between C2 and C3 being about 0.355).

In the illustrated embodiment, the length L2 is about 20.00 inches, the width W2 is about 12.50 inches and the maximum thickness T2 is about 2.44 inches (as defined in the first region 230). Once again, the pillow 200 can have any number of other dimensions depending upon the particular application and intended use. The present disclosure also includes like pillows of similar proportions but different dimensions for use by children. In some embodiments, a children's pillow 200 of the present disclosure will have a lower radius of curvature R1, and/or a lower distance D4 and/or D5.

It will be appreciated that the dimensions of the embodiment shown in FIG. 7 are merely exemplary in nature and not limiting of the present disclosure.

In a third embodiment, the present disclosure provides a third pillow 300 as shown in FIGS. 10-15. The third pillow 300 is specifically constructed to be a hybrid/multifunctional pillow in that the construction of the pillow 300 is designed to accommodate both persons that sleep in the supine position and in the side-lying position. For example, many people do not maintain the same sleep position all night and instead move between different positions. Amongst this group of people, it is most common that people alternate between the supine position and the side-lying position. As a result, it is desirable for a pillow to accommodate both positions and offer a therapeutic benefit in both positions. The pillow 300 of the present disclosure achieves this objective.

The pillow 300 thus shares similarities to both the pillow 100 (side-lying position pillow) and the pillow 200 (supine position pillow). In particular, the pillow 300 includes at least one first section 400 that has a construction that is identical or very similar to the construction of the pillow 100 and has at least one second section 500 that has a construction that is identical or very similar to the construction of the pillow 200. In the illustrated embodiment, the pillow 300 includes a single second section 500 and includes two first sections 400, with the second section 500 being formed between the two first sections 400 and therefore, the first sections 400 define the two ends (lateral sides) of the pillow 300. As a result, in the above arrangement, a supine sleeping position is in the center of the pillow, while the side-lying positions are adjacent thereto and are located on either side of the supine sleeping position. The user thus can roll in either the left direction or the right direction from the center supine position to one of the respective side-lying positions and, conversely, can move from one of the side-lying position to the center supine position.

It will be appreciated that in accordance with the present disclosure, the pillow 300 can be formed such that it only consists of a single first section 400 and a single second section 500 located side-by-side.

In the illustrated embodiment, the construction of the different sections 400 and 500 of the pillow 300 can be the same as the constructions of the corresponding individual pillows 100 and 200. Therefore, like elements are numbered alike among these pillows. In other words, the first section 400 of the pillow 300 includes the first region 130, second region 140 and third region 150 having the contours described hereinbefore with reference to pillow 100. Similarly, the second section 500 includes the first region 230, second region 240, and third region 245 and thus, has ribs 250 as described herein in the first region 230.

As shown in FIGS. 11-15, the second section 500 has a thickness that is less than the first section(s) 400 and is thus recessed relative to the adjacent section(s) 400.

It will be appreciated that the relative dimensions, such as the width, of each pillow section can be varied depending upon the particular application, such as the pillow size (e.g., standard, queen, king, etc.).

More specifically, since the pillow 300 is a hybrid pillow and includes both supine and side-lying sections, some of the dimensions of the pillow 300 are increased. For example, the length (L3) of the pillow 300 can be about 27.00 inches, while the width (W3) is about 12.5 inches (as with the other pillows 100, 200). Each first section 400 can have a length of about 9.00 inches and therefore, when there are two first sections 400 as shown in FIG. 11-15, the single center second section 500 likewise has a length of about 9.00 inches. Thus, while in the illustrated embodiment, the three sections 400, 500, 400 have the same length, the pillow 300 can made such that the sections are of different lengths. For example, the second section 500 can have a length that is greater than the length of the one or more first sections 400 and alternatively, the second section 500 can have a length that is less than the sections 400.

Figure 14:
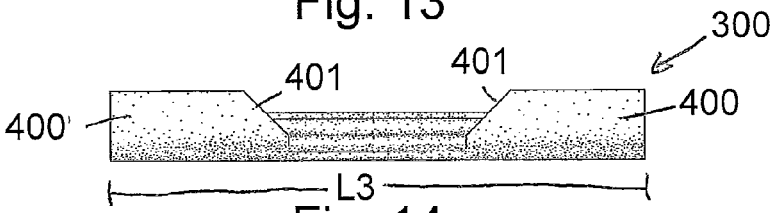
FIG. 14 is a front elevation view thereof.
Figure 15:
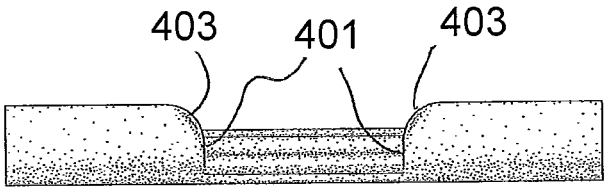
FIG. 15 is a front elevation view showing another pillow embodiment.

The transition between the first section 400 and the second section 500 can have any number of different structures, including those shown in FIGS. 14 and 15. In particular, in FIG. 14, the inner edges 401 of the first sections 400 can be in the form of beveled edges, such as a beveled edge that is formed at a 45 degree angle as shown. This beveled edge 401 provides a ramp like structure between the section 400 and section 500 that permits the user to move from one region to the other region and vice versa. The edge 401 can be formed at other angles as well.

In FIG. 15, the edge 401 is formed at a substantially 90 degree angle; however, the edge 401 includes a rounded top 403. This provides a softened edge that allows the user to more easily move from one section 400 or 500 to the other section.

In addition, while the two free ends of the pillows illustrated in FIGS. 1-15_have a 90 degree clean cut edge, it will be appreciated that the ends of the pillow can be formed to have other shapes such as a more rounded shape or another shape.

The pillow 300 can be formed using any number of conventional techniques, such as those described hereinbefore. In one embodiment, the pillow 300 can be formed as a single piece construction in that the different regions 400, 500 of the pillow 300 are formed in a common manufacturing process, such as a common mold process (vacuum injection mold process). As a result, the pillow 300 has a single unitary, integral construction.

Figure 11:
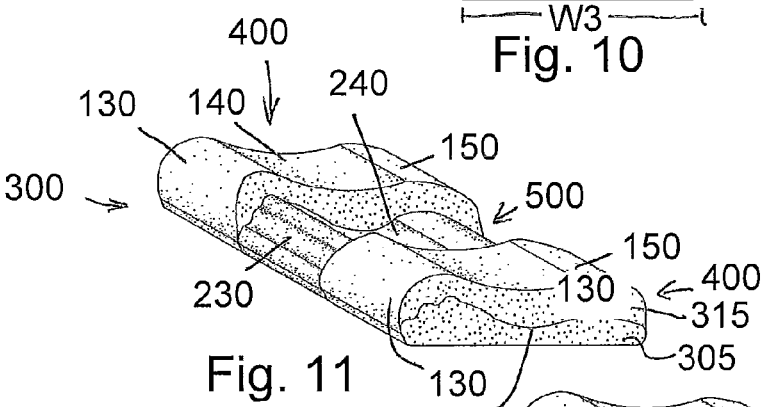
FIG. 11 is a perspective view thereof showing a two part construction embodiment.

Alternatively as shown in FIG. 11, the pillow 300 can be formed as a two piece construction in that the pillow 300 can include an underlying base layer 305 and a top layer 315 that mates with the base layer 305 to form the pillow 300 with the regions 400, 500. For example, the base layer 305 and top layer 315 can be formed in separate molding operations to form the separate contoured pillow base layer 305 and top layer 315. It will be appreciated that the base layer 305 has the form of the pillow 200 (supine position pillow) and the top layer 315 has the form of the pillow 100 at least in part. In particular, a top surface of the top layer 315 has the contoured shape of the pillow 100 in that the top surface of the top layer 315 includes the regions 130, 140, 150 that provide the therapeutic effect for when a user is in a side-lying position.

An underside 317 of the top layer 315 is thus a mirror image of the top surface of the base layer 305 (pillow 200) such that when the two mate together with the underside 317 mating with the top surface of the base layer 305, a clean fit results. The two parts 305, 315 can be adhered to one another using conventional techniques including but not limited to using an adhesive that is placed between the two parts 305, 315.

Any one of the pillows described and illustrated herein can include a locator member that easily permits the user to determine the positioning of the pillow within a pillowcase. For example, the pillow can have a tab (protrusion) that extends outwardly from one section of the pillow, such as at a front edge in order to easily to provide a tactile indicator to a user to allow the position of the pillow to be easily determined especially when the pillow may be covered with a pillowcase or the like.

In one embodiment, all of the pillows described herein are constructed to fit within a standard pillowcase as opposed to requiring a custom pillowcase. Alternatively, the pillow can be fitted with a custom pillowcase that is cut to the shape of the underlying pillow.

It will also be understood that an accessory (not shown) can be provided for use with the pillow 300 in that a middle top section that is similar to or identical to the part 315 can be provided for insertion into the open space above the section 500 between the two sections 400. This accessory would result in the pillow 300 having a uniform design across all three sections.

The underside surface of the accessory thus has a shape that is a mirror image of the top surface of the section 500 to allow a clean, intimate mating (flush fit) between the accessory and the second section 500. The accessory can be used to transform the pillow 300 into a complete side-lying pillow. In addition, the accessory can have different material characteristics compared to the parts 315 that formed the sections 400. For example, the density (e.g., foam density) can be different than the parts 315 to provide a different feel in the center section compared to the other sides. The accessory can be freely removed from the pillow 300. One or more fasteners, such as hook and loop material can be provided in one or more areas that are not in contact with the user of the pillow 300 for providing some means for securing the accessory to the pillow 300.

Now referring to FIGS. 16-21, a pillow 600 is formed of a body 610 (such as a viscoelastic foam body) that is defined by a top surface 612 on which the user's body rests; an opposite bottom surface 614, a first side 616, an opposite second side 618, a front 620 and an opposite rear 622. The pillow 600 has a length L1 and a width W1 and a variable thickness T1 across the width W1 of the pillow 600 as described below.

The pillow 600 is of a type that is configured for use with side sleeping individuals.

The pillow 600 is formed such that it has several distinct regions that are designed to contact and support the neck (spine) and head of the user. As best shown in the side views of FIGS. 16 and 19, the pillow 600 has a number of different regions from the front edge 620 to the rear edge 622. From the front edge 620 to the rear edge 622, the pillow 600 has a step construction with the pillow 600 having a maximum thickness at the front edge 620 and a minimum thickness at the rear edge 622. Between these two areas, the thickness of the pillow 600 varies depending upon the particular regions of the pillow 600 and has a step-like construction.

The front edge 620 includes a pair of cut-outs 630 that are each designed to fit a shoulder of an individual. Each cut-out 630 is in the formed pillow body and has a curved shape and in particular, has an arcuate shape (e.g., crescent shape). These shoulder cut-outs help position the user's neck in the correct part of the pillow, ensuring optimum alignment of the vertebrae.

In one exemplary embodiment, the depth of the cut-out 630 is about 1.50 inches as measured from the front edge 620 to a center point of the cut-out 630. The two cut-outs 630 can have equal lengths (e.g., 7.81 inches) and are spaced apart from one another a prescribed distance (e.g., 1.98 inches) that is selected such that if a person's shoulder (such as the left shoulder) is disposed within one cut-out 630 (such as the right cut-out 630) and then the user rolls over for sleeping on the opposite side, the user's other shoulder (e.g., right shoulder) will naturally fall into the other cut-out 630 (i.e., left cut-out 630). The shoulder cut-outs 630 help serve as a locating feature for locating the shoulder of the user in a side sleeping position. For optimum alignment of the spine, it is preferably for a user to position him or herself using one of the cut-outs so that the user's head is facing the outside edge of the pillow (i.e., the right shoulder is located in the left cut-out, or the left-shoulder is located in the right cut-out).

As described herein, the various regions of the pillow 600 are specifically designed to provide equal pressure across the head and neck areas of the individual as the individual rests his or her head on the pillow 600 in the manner described herein. In one embodiment, the pillow 600 can have a length of about 26.0 inches and a width of about 14.10 inches.

According to the present disclosure, the pillow 600 includes a first region 700 that terminates at the rear edge 622 and includes the cut-outs 630. The first region 700 is a planar region in which the thickness of the pillow 600 is uniform. A second region 710 is a region of the pillow 700 that has an incline (upward slope) in the direction of the rear edge 622 to the front edge 620. The second region 710 thus has variable thickness.

The pillow 600 includes a third region 720 that is adjacent the second region 710. The third region 720 is a region in which the thickness of the pillow does vary in that there is a slight increase in the forward direction of the pillow 600. The third region 720 has a slight concave shape. The third region 720 can have a variable slope in itself in that a front portion 722 of the third region 720 has a greater slope than a rear portion 724 of the third region 720. The front portion 722 represents the second step of the pillow 600. The slope of this second step is less than the slope of the first step defined by the second region 720.

However, the slope of the second region 710 is substantially greater than the slope of the third region 720 since the second region 710 serves as a distinct inclined "step" construction between two relatively planar sections.

The pillow also includes a fourth region 730 that defines the front edge 620 of the pillow 600. The fourth region 730 is a planar section in that the thickness of the fourth region 730 is at least substantially uniform throughout the fourth region 730. The first and fourth regions can thus be planar sections that lie in different planes (i.e., parallel planes).

Figure 16:
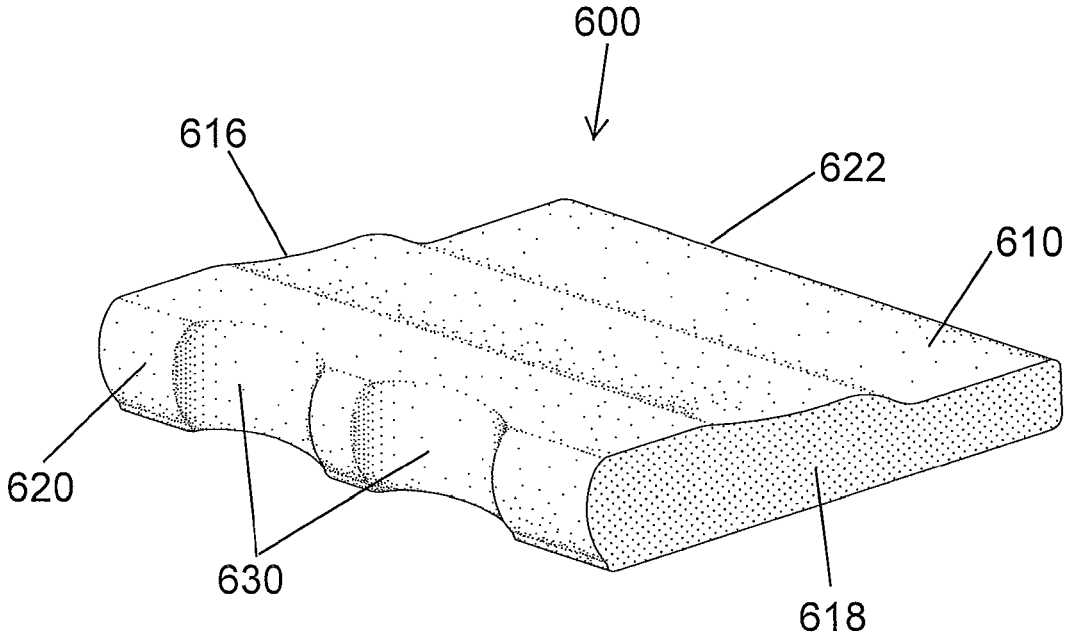
FIG. 16 is a front and side perspective view of a pillow according to another embodiment.
Figure 17:
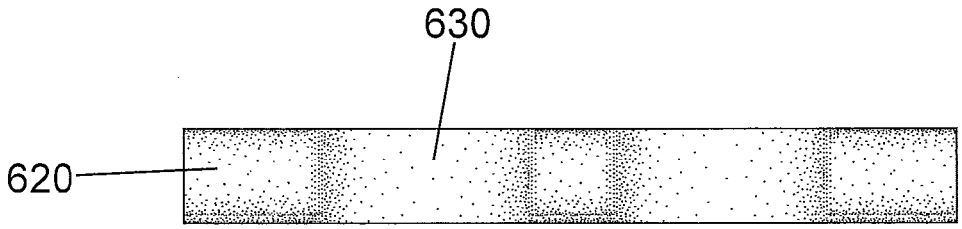
FIG. 17 is a front elevation view of the pillow of FIG. 16.
Figure 18:
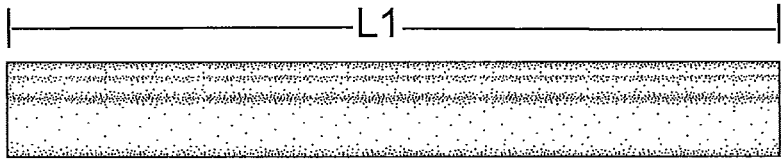
FIG. 18 is a rear elevation view of the pillow of FIG. 16.
Figure 19:
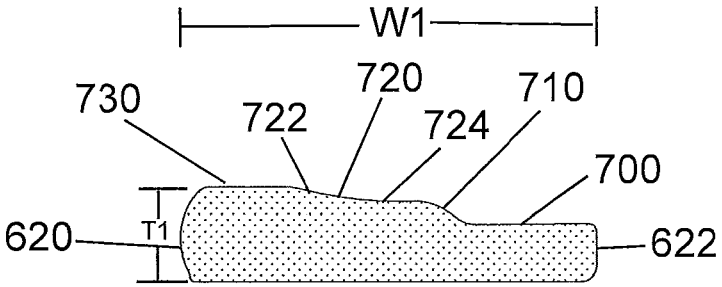
FIG. 19 is a side elevation view of the pillow of FIG. 16.
Figure 20:
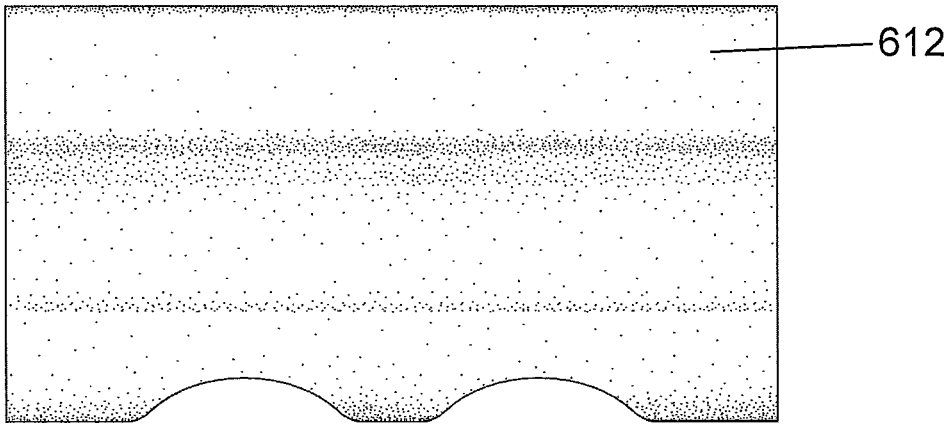
FIG. 20 is a top plan view of the pillow of FIG. 16.
Figure 21:
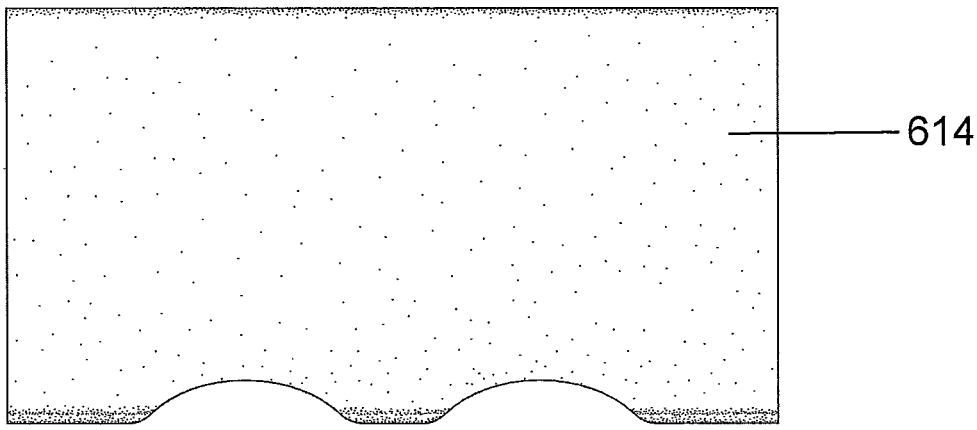
FIG. 21 is a bottom plan view of the pillow of FIG. 16.

As shown in FIG. 16 and FIG. 19, the front edge 620 can be a curved edge (e.g., rounded edge (convex edge)), while the rear edge 622 can be a substantially flat edge.

As previously mentioned, the pillow 600 has a construction that provides for equal pressure across the neck and head of the user and more particularly, the stepped construction allows for compression of the pillow such that the spine is maintained in a neutral position. When a user rests his or her head on the pillow 600, the top of the head will seat on and be supported by the first region 700. The user's head extends along the first region 700, the second region 710 and at least the rear portion 724 of the third region 720. The neck of the user rests on the fourth region 730 and at least partially on the third region 720 (e.g., the front portion 722 thereof).

The fourth region 730 has increased thickness compared to the other regions and thus represents a higher structure since in a side sleeping position, the natural shape of the neck includes an inward taper since the head has a greater width than the neck.

The stepped construction provides different thicknesses of material and therefore, has a complex compression profile across the width of the pillow 600. However, the compression profile is designed such that when the pillow 600 is in use, the spine is maintained in a substantially neutral position. In other words, the stepped construction of the pillow 600 is configured such that the head and neck (spine) are supported evenly across the width of the pillow 600. In other words, the different compression profiles of the different regions of the pillow 600 based on the thickness of the pillow 600 in the region and based on the contour of the pillow in the region cause the pillow to compress so as to maintain the user's spine in the neutral position.

In one embodiment, the pillow 600 includes a maximum thickness of about 3.25 inches.

In accordance with the present disclosure and as shown in FIGS. 22-27, a pillow 800 is provided according to another embodiment and is specifically constructed to be a hybrid/multifunctional pillow in that the construction of the pillow 800 is designed to accommodate both persons that sleep in the supine position and in the side-lying position. For example, many people do not maintain the same sleep position all night and instead move between different positions. Amongst this group of people it is most common that people alternate between the supine position and the side-lying position. As a result, it is desirable for a pillow to accommodate both positions and offer a therapeutic benefit in both positions. The pillow 800 shares some similarity to the pillow 300 described herein.

The pillow 800 thus shares similarities to both the pillow 600 (side-lying position pillow) and the pillow 200 (supine position pillow). In particular, the pillow 800 includes at least one first section 900 that has a construction that is identical or very similar to the construction of the pillow 600 and has at least one second section 1000 that has a construction that is identical or very similar to the construction of the pillow 200. In the illustrated embodiment, the pillow 800 includes a single second region 1000 and includes two first sections 900, with the second section 1000 being formed between the two first sections 900 and therefore, the first sections 900 define the two ends (lateral sides) of the pillow 800. As a result, in the above arrangement, a supine sleeping position is in the center of the pillow, while the side-lying positions are adjacent thereto and are located on either side of the supine sleeping position. The user thus can roll in either the left direction or the right direction from the center supine position to one of the respective side-lying positions and conversely, can move from one of the side-lying position to the center supine position.

It will be appreciated that in accordance with the present disclosure, the pillow 800 can be formed such that it only consists of a single first section 900 and a single second section 1000 located side-by-side.

In the illustrated embodiment, the construction of the different sections 900 and 1000 of the pillow 800 can be the same as the constructions of the corresponding individual pillows 600 and 200 and therefore, like elements are numbered alike. In other words, the first section 900 includes the regions 700-730 having the contours described hereinbefore with reference to pillow 600. Similarly, the second section 1000 includes the first region 230, second region 240, and third region 245 and thus, has ribs 250 as described herein in the first region 230.

As shown in FIGS. 22-24 and 26, the second section 1000 has a thickness that is less than the first section(s) 900 and is thus recessed relative to the other adjacent section(s) 900. As a result, a side wall 1005 is located between the first section 900 and the second section 1000. The side wall 1005 is thus a transition wall between the two sections and as shown in the figures, the side wall 1005 has a variable height in that at a rear 802 of the pillow 800, the side wall 1005 has a minimum height. The side wall 1005 can also be formed at an angle (beveled wall) as shown in the figures.

It will be appreciated that the relative dimensions, such as the width, of each pillow section can be varied depending upon the particular application, such as the pillow size (e.g., standard, queen, king, etc.).

More specifically, since the pillow 800 is a hybrid pillow and includes both supine and side-lying sections, some of the dimensions of the pillow 800 can be increased. For example, the length of the pillow 800 can be about 26.00-27.00 inches, while the width is about 14.1 inches (as with the other pillows 100, 200). In one illustrated embodiment, the three sections 900, 1000, 900 can have the same length, the pillow 800 can made such that the sections are of different lengths. For example, the second section 1000 can have a length that is greater than the length of the one or more first sections 900 and alternatively, the second section 1000 can have a length that is less than the sections 900.

Figure 23:
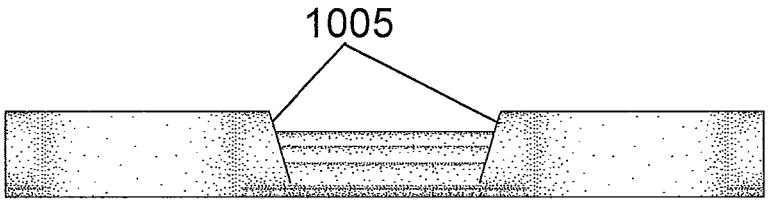
FIG. 23 is a front elevation view of the pillow of FIG. 22.
Figure 24:
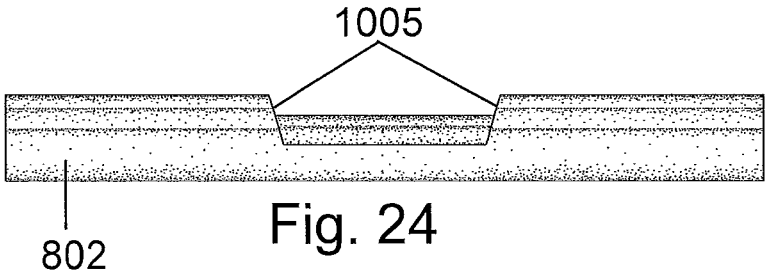
FIG. 24 is a rear elevation view of the pillow of FIG. 22.
Figure 25:
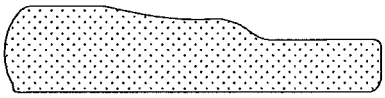
FIG. 25 is a side elevation view of the pillow of FIG. 22.
Figure 26:
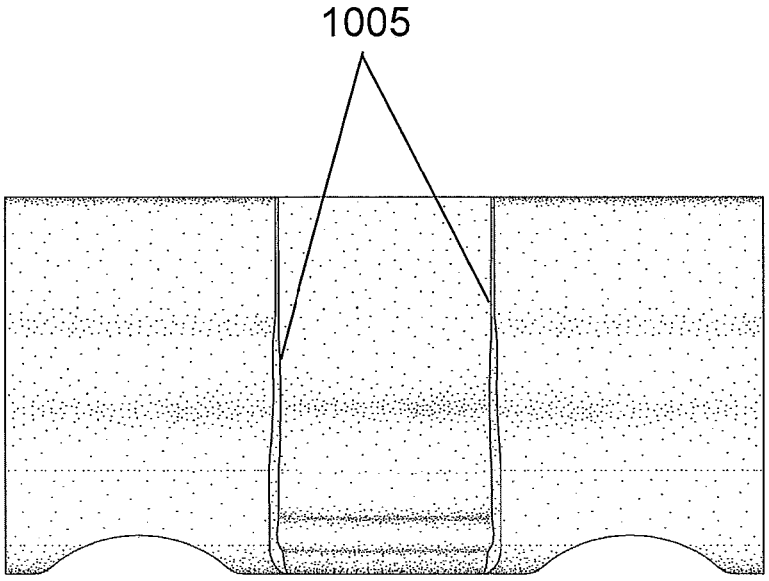
FIG. 26 is a top plan view of the pillow of FIG. 22.
Figure 27:
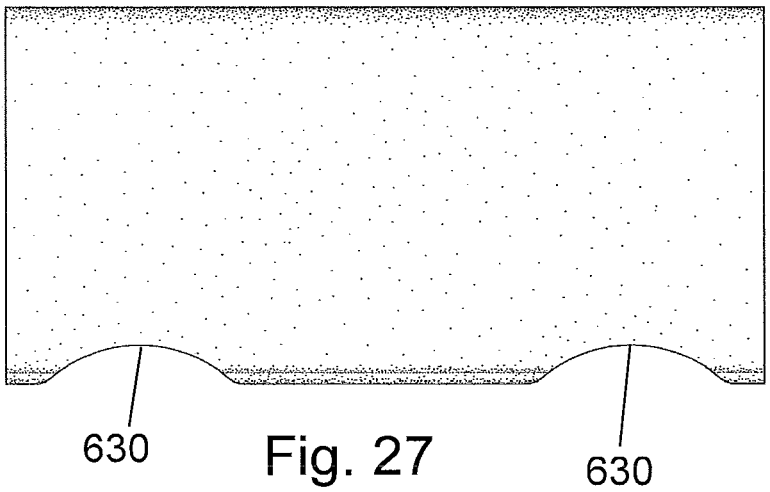
FIG. 27 is a bottom plan view of the pillow of FIG. 22.

The transition between the first section 900 and the second section 1000 can have any number of different structures, including those shown in FIGS. 23-24. In particular, in FIGS. 23-24, the inner edges of the first sections 900 can be in the form of beveled edges, such as a beveled edge as shown. This beveled edge provides a ramp like structure between the section 900 and section 1000 that permits the user to move from one region to the other region and vice versa.

The inner edge can be formed at a substantially 90 degree angle and can include a rounded top. This provides a softened edge that allows the user to more easily move from one section 900, 1000 to the other section.

In addition, while the two free ends of the pillows illustrated in FIGS. 1-27 have a 90 degree clean cut edge, it will be appreciated that the ends of the pillow can be formed to have other shapes such as a more rounded shape or another shape.

The pillow 800 can be formed using any number of conventional techniques, such as those described hereinbefore. In one embodiment, the pillow 800 can be formed as a single piece construction in that the different regions 900, 1000 of the pillow 800 are formed in a common manufacturing process, such as a common mold process (vacuum injection mold process). As a result, the pillow 800 has a single unitary, integral construction. Alternatively, the pillow 800 can be formed as a two piece construction in that the pillow 800 can include an underlying base layer and a top layer that mates with the base layer to form the pillow 800 with the regions 900, 1000. For example, the base layer and top layer can be formed in separate molding operations to form the separate contoured pillow base layer and top layer.

It will also be understood that an accessory (not shown) can be provided for use with the pillow 800 for insertion into the open space above the section 1000 between the two sections 900. This accessory would result in the pillow 800 having a uniform design across all three sections, with the exception of the cut-outs present only in the two sections 900.

In another embodiment, any of the pillows disclosed herein (e.g., pillows 100, 200, 300, 600, 800, or pillows 1.1-21) can optionally include in their construction a means of altering the height or thickness of the pillow. On one embodiment, said means is a fabric pocket disposed, for example, along the bottom surface of the pillow. Said pocket is, open at least along any one edge, e.g. along either the front edge of the pillow and/or the rear edge of the pillow, and said pocket extends across the entire length and width of the pillow. Into said pocket can be inserted foam inserts sized to substantially conform to the length and width of the pillow, and capable of being used in different heights (thicknesses). These inserts enable the user to adjust the total height or thickness of the pillow to suit their personal preference or medical need. Optionally, the pocket may be designed to accept single inserts of varying thicknesses, or multiple inserts of a common or of varying thickness. The latter option would enable the user to adjust the height or thickness of the pillow in stepped increments. For example, each insert can have a thickness of 0.25 to 2 inches, or 0.5 to 1 inch. Preferably, the inserts are of a foam density that provides stiffness, such that the added height provided by the insert is not unduly compressed under the weight of the user's head and neck. In a specific embodiment of the present disclosure, the inserts as described above are wedge-shaped, such that they can be used to increase the height of the back of the pillow more than the front of the pillow. Such a wedge insert would be particularly useful for patients suffering from respiratory ailments such as chronic obstructive pulmonary disease (COPD), wherein the further elevation of the back of the head could promote the maintenance of a more-open or less obstructed airway. Optionally, the wedge insert's dimensions may extend beyond the dimensions of the pillow, for example, such that the forward edge of the wedge extends under the user's upper back (in order to elevate the lungs as well as the head and neck).

In another embodiment, the means of altering the height or thickness of the pillow is the provision of attachment points on the pillow for shims. Such shims are foam pads similar in size and shape to the aforementioned inserts, and they can be reversibly affixed to the lower surface of the pillow by any suitable means. For example, the bottom surface of the pillow and the top surface of the shim can be provided with matching circles, squares or strips of hook-and-loop fastening material (e.g., Velcro™), such that the hooks on one surface engage the loops on the other surface. Thus, the shim is reversibly affixed to the bottom of the pillow, resulting in a pillow of overall increased height or thickness. Another means of attachment could be the provisions of buttons or snaps on the sides of the pillow that are matched to corresponding buttons or snaps on flaps of fabric attached to the shims. In this manner, when the pillow is laid upon the shim with their surfaces overlapping, the fabric material of the shim overlaps the sides of the pillow enabling the engagement of snaps or buttons to secure the two together. As described above for inserts, the above-mentioned shims could also be adapted to form a wedge shape, optionally extending in its dimensions further than the pillow, and particularly for use with persons suffering from respiratory ailments such as COPD.

In another embodiment, the means of altering the height or thickness of the pillow is a provision in the pillow for two-piece construction as described above, allowing for the insertion of inserts or shims of specified thickness between the aforementioned base layer and top layer of the two-piece pillow. For example, as shown in FIG. 11, the pillow 300 can be designed to consist of a top layer 315 and a bottom layer 305, which may be adhered to each other. In some embodiments, they may be adhered reversibly, such that an insert could be placed between the layers 315 and 305 in order to increase the total thickness of the pillow's section 400. The same kind of split two-piece construction may be incorporated into any pillow of the present disclosure.

Figure 12:
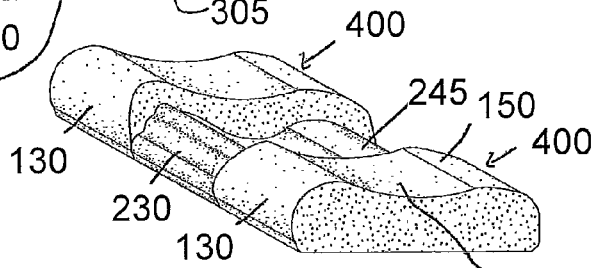
FIG. 12 is a perspective view thereof showing a single unitary construction embodiment.
Figure 13:
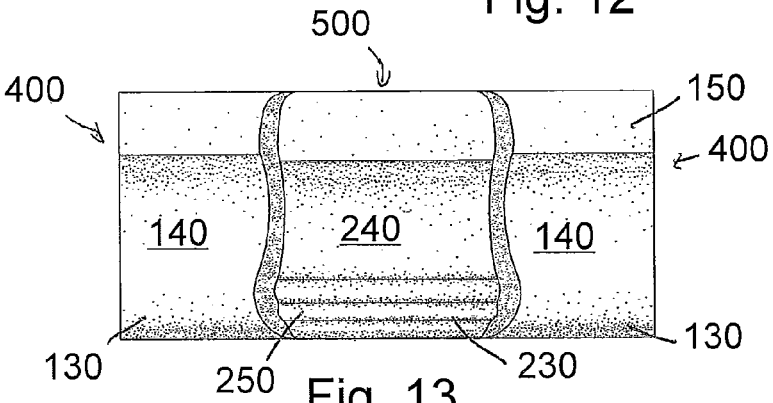
FIG. 13 is a top plan view thereof.
Figure 22:
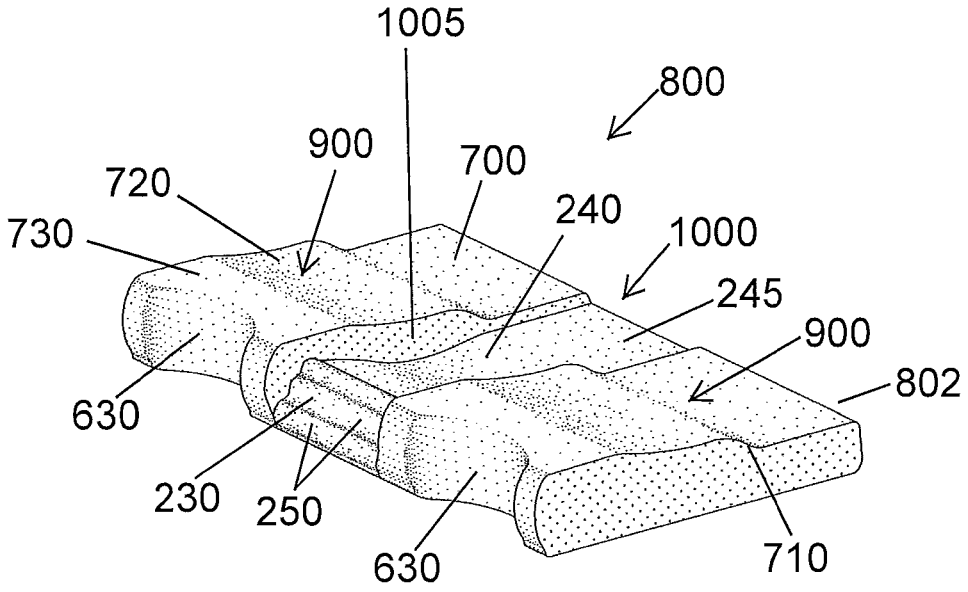
FIG. 22 is a front and side perspective view of a pillow according to another embodiment.

In some embodiments, the shim or insert is designed to uniformly increase the height of a pillow 300 or pillow 800, but in other embodiments, the placement of inserts can be designed to only increase the height of the side-sleeper sections of the pillow 300 or 800 (i.e., sections 400 in FIGS. 11 and 12; or sections 900 in FIG. 22). For example, if the pillow 300 or 800 has the two-piece construction described above (as shown, for example, in FIG. 11), then two separate inserts can be placed between the base layer and the top layer, one insert for each section 400 or 900.

In each of the above embodiments, the insert or shim that is intended to alter the height of the pillow is preferably made of a foam that is considerably more firm and less compressible than the foam of the pillow itself. For example, the insert or shim may be composed of a foam with a 25% IFD of greater than 20 lbs, or greater than 30 lbs, or greater than 40 lbs, and preferably 40-50 lbs., and/or a Ball Rebound Test value of about 40-60%, and preferably about 45%.

In all of the aforementioned pillows, the external surface of the pillow may be covered in any suitable fabric that is typically used for bedding products. For example, the viscoelastic foam core can be covered with a polyester, cotton or blended fabric. Such fabric will be chosen to optimize the desired comfort, resilience, softness and support. Optionally, such fabric can include enhancements such as antimicrobial additives, fragrances, enhanced fire retardants, or exotic fiber materials.

The pillows of the present disclosure may be further defined as follows:

1.1. A pillow comprising:

a foam body having a top surface, an opposing bottom surface, a rear edge and an opposing front edge and lateral sides, wherein the foam body is defined by a first region that includes the front edge, a second region adjacent the first region and a third region adjacent the second region and defining the rear edge, wherein the first region has a convex shape, the second region has a concave shape and the third region has a convex shape, the pillow having a maximum thickness in the first region and a minimum thickness in the second region, the first region having a first section that extends to the front edge and has a positive slope and an adjacent second section that has a negative slope and extends to the second region, wherein the front edge has a height greater than the rear edge; and a plurality of ribs extending longitudinally between the lateral side and being located exclusively within the first section of the first region which has positive slope, the second section of the first region which has negative slope being free of ribs;

and a means for altering the height or thickness of the pillow (e.g., a pocket disposed along the bottom surface and open along one or more edges and sized to enable insertion of foam inserts to raise the height of the pillow);

1.2. Pillow 1.1, wherein the foam body is formed of viscoelastic foam, whereby a head and neck of a user arches back over the first region as supported by the foam body when the user is in a supine position with the head being at least substantially contained in the second region;

1.3. Pillow 1.1 or 1.2, wherein each rib comprises a rounded rib;

1.4. Any of pillows 1.1-1.3, wherein the rounded rib has a convex shape;

1.5. Any of pillows 1.1-1.4, wherein the ribs extend along the entire length of the foam body from one lateral side to the other lateral side;

1.6. Any of pillows 1.1-1.5, wherein the plurality of ribs comprises, from two to six ribs, for example, three ribs, namely, a front rib, a middle rib and a rear rib, with a first distance being defined between the front rib and middle rib and a second distance being defined between the middle rib and the rear rib, as measured along a width of the foam pillow;

1.7. Any of pillows 1.1-1.6, wherein the first region is defined by a first radius of curvature and a second region is defined by a second radius of curvature, and the third region is defined by a third radius of curvature, the third radius of curvature being greater than the first radius of curvature;

1.8. Any of pillows 1.1-1.7, wherein the plurality of ribs have convex shapes with a radius of curvature that defines each rib being at least substantially equal;

1.9. Pillow 1.8, wherein the first radius of curvature is about 3.944 inches; the second radius of curvature is about 3.927 inches and the third radius of curvature is about 6.693 inches;

1.10. Any of pillows 1.1-1.9, wherein the front rib defines a forward-most point of the foam body;

1.11. Any of pillows 1.1-1.10, wherein the second section has a step configuration;

1.12. Pillow 1.11, wherein the second section includes a pair of steps located between first and second planar portions that are located at the front edge and rear edge, respectively, of the pillow;

1.13. Pillow 1.12, wherein the first and second planar portions are parallel to one another;

1.14. Pillow 1.12 or 1.13, wherein the pair of steps includes a first step having a first slope and a second step having a second slope, the first slope being greater than the second slope and located closer to the rear edge;

1.15. Pillow 1.14, wherein a length of the second step is greater than a length of the first step;

1.16. A pillow comprising:

a foam body having a top surface, an opposing bottom surface, a front edge, a rear edge and an opposing front edge and lateral sides extending between the rear and front edges, wherein the foam body is defined by a first (middle) section constructed for use when a user is in the supine sleeping position and a pair of adjacent second (outer) sections for use when the user in the side-lying position, the first section being disposed between the second sections;

wherein the first section includes:

a first region that includes the front edge, a second region adjacent the first region and a third region adjacent the second region and defining the rear edge, wherein the first region has a convex shape, the second region has a concave shape and the third region has a convex shape, the first region having a first section that extends to the front edge and has a positive slope and an adjacent second section that has a negative slope and extends to the second region, wherein the front edge has a height greater than the rear edge; and a plurality of ribs extending longitudinally between the lateral side and being located exclusively within the first section of the first region which has positive slope, the second section of the first region which has negative slope being free of ribs; and wherein the second section includes a pair of arcuate shaped cut-outs formed in the front edge, the arcuate shaped cut-outs being spaced apart along the front edge for receiving a shoulder of a user in the side-lying position; and a means for altering the height or thickness of the pillow (e.g., a pocket disposed along the bottom surface and open along one or more edges and sized to enable insertion of foam inserts to raise the height of the pillow);

1.17. Pillow 1.16, wherein the foam body is formed of viscoelastic foam, whereby a head and neck of a user arches back over the first region as supported by the foam body when the user is in a supine position with the head being at least substantially contained in the second region;

1.18. Pillow 1.16 or 1.17, wherein each rib comprises a rounded rib;

1.19. Any of pillows 1.16-1.18, wherein the plurality of ribs comprises three ribs, namely, a front rib, a middle rib and a rear rib, with a first distance being defined between the front rib and middle rib and a second distance being defined between the middle rib and the rear rib, as measured along a width of the foam pillow;

1.20. Any of pillows 1.16-1.19, wherein the plurality of ribs have convex shapes with a radius of curvature that defines each rib being at least substantially equal;

1.21. Any of pillows 1.16-1.20, wherein an inner beveled wall is formed at an interface between the first section and each second section, each inner beveled wall being angled in a lateral direction toward the respective second section which defines one respective lateral side, the inner beveled wall having a varying height as measured from the rear edge to the front edge.

In another aspect, the present disclosure provides a vehicular headrest comprising a foam pillow according to the present disclosure. In this aspect, the headrest comprises a pillow, e.g., pillow 200, positioned so that the ridged portion 230 is positioned behind the neck of the user, and the curved portion 240 is positioned behind the head of the user. In this embodiment, in the event of a sudden acceleration or deceleration (as would occur following air-bag actuation), the ribbed region of the pillow would serve to protect the user's neck from injury. Conventional headrests provide a cushioning support for the head only, with no support for the neck. The use of a headrest comprising a pillow of the present disclosure would thus serve to prevent injury to the neck during an accident. In some embodiments of this aspect, the vehicle may be an automobile, an autobus, an airplane, a train, or any other moving vehicle in which a user is seated with a headrest generally present to prevent excessive backward movement of the head.

In another aspect, the present disclosure provides a cushion or head-rest to be used with either an inclined (e.g., about 45 degree inclined) or upright (e.g., 80-100 degree inclined, or 90 degree inclined) chair or seat to provide optimum alignment of the spine while a person reclines on said chair or seat. In this aspect, the cushion or headrest comprises a pillow, e.g., a pillow 200, positioned so that the ridged portion 230 is positioned behind the neck of the user, and the curved portion 240 is positioned behind the head of the user, or e.g., a pillow 600, positioned so that the cut-outs 630 can receive the user's shoulder and user's head can rest on the stepped regions 616 and/or 610. In a further embodiment, this aspect of the disclosure may provide for a wedge-shaped insert, the insert designed as described above.

In another aspect, the present disclosure provides a method (Method 1) of maintaining or improving the curvature and/or alignment of the cervical and/or thoracic vertebrae of a human, the method comprising sleeping with the head and neck supported by a pillow designed to improve curvature and/or alignment of the cervical and/or thoracic vertebrae. In one embodiment, said pillow comprises a foam body and a first forward region of convex curvature, a second middle region of concave curvature, and a third rear region of convex curvature. In another embodiment, said pillow comprises a stepped configuration in which the front portion of the pillow is of greater height than the rear portion of the pillow. In another embodiment, said pillow may comprise three adjacent sections, a middle back-sleeper section with two adjacent outer side-sleeper sections, wherein each section comprises a first forward region of convex curvature, a second middle region of concave curvature, and a third rear region of convex curvature, and wherein the outer side-sleeper sections are of greater thickness than the middle back-sleep section. In another embodiment, the method comprises the use of any of the pillows of the present disclosure (e.g., pillow 100, 200, 300, 600 or 800, or any of pillows 1.1-1.21) according to the aforementioned guidelines. In a further embodiment, the human is a patient suffering from an ailment of the neck or cervical vertebrae, such as a misalignment of the cervical vertebrae, and the method is applied to a patient in need of treatment therefor. Due to its unique design, sleeping with the head and neck supported by the pillow disclosed herein results in the cervical and/or thoracic vertebrae adopting a clinically improved curvature and/or alignment, and continued use of these pillows during sleep will result in gradual improvement of curvature and alignment of the vertebrae during waking hours. In one embodiment, the method is effective for treating or ameliorating (e.g., reducing or eliminating the symptoms of) ailments of the spine, neck or cervical vertebrae, for example: misalignment of the cervical vertebrae, chronic or acute neck pain, back pain, or shoulder pain, headache, numbness of the extremities, excessive abnormal curvature of the cervical or thoracic vertebrae (e.g., kyphosis or lordosis), cervical or lumbar arthritis, or disorders of the intervertebral discs (e.g., disc inflammation, disc prolapse, disc herniation).

The inventors have discovered that even persons who appear without identifiable spinal injury or disease, and who have cervical or thoracic curvature or alignment considered within the normal range, when sleeping on traditional commercial pillows, can have their vertebrae forced into an unnatural or unhealthy alignment. While this improper alignment usually does not persist after waking, having spent many hours sleeping with such improper alignment, users can experience neck or back pain of apparently unknown cause. By sleeping on pillows of the present disclosure, however, normal users without spinal injury or disease can avoid the above problems because the pillows of the present disclosure will maintain optimal cervical alignment during sleep. Thus, in some embodiments, the pillows of the present disclosure help maintain healthy cervical and/or thoracic curvature and/or alignment in persons without apparent spinal injury or disease.

In a particular embodiment, the method may comprise sleeping on said pillow for a period of time from 2 hours to 10 hours per night, preferably from 6 to 8 hours, and doing so on a regular basis (e.g., every night) for a sufficient period of time to result in reduction or resolution of symptoms (e.g., at least 2 weeks, or at least 4 weeks or at least 8 weeks). In another embodiment, the method comprises sleeping on said pillow on a regular basis for an extended period of time (e.g., several months or years, or an indefinite period of time) in order to maintain healthy spinal curvature and alignment.

In a particular embodiment, the user (e.g. patient) has been diagnosed, for example, by X-ray radiography, as having an abnormal curvature or alignment of the cervical or thoracic vertebrae, and when the user lies on a pillow of the present disclosure, the pillow supports the user's neck into a healthier alignment or curvature. For example, where a patient suffers from hypo-lordosis (insufficient anterior concavity of the cervical vertebrae), use of the pillow during sleep may result in the user's neck being supported into a more concave arch. Over time, this may result in improved neck curvature during waking hours, and consequently, reduced adverse symptoms associated with the cervical condition (e.g., reduced pain).

In yet another embodiment, a method according to any of Methods 1 or 1.1-1.34, is provided whereby use of the pillow of the present disclosure results in improved respiration, resulting from improved alignment of the cervical trachea with the oral cavity and thoracic trachea. This may increase the comfort and quality of the patient's sleep, including, for example, reducing the incidence of sleep apnea or snoring. In a particular embodiment, this method may apply to a user suffering from a heart or respiratory ailment, such as chronic obstructive pulmonary disease (COPD), wherein use of the pillow helps alleviate some symptoms of the ailment.

In another embodiment of any of Methods 1 or 1.1-1.34, the method comprises the use of a pillow as depicted in the drawings of U.S. Design Pat. Nos. D402,150, D696,045, D696,046 and D696,047, each of which are hereby incorporated by reference in their entirety.

The methods of the present disclosure may be further described as follows:

1.1. A method according to Method 1, of maintaining or improving the curvature and/or alignment of the cervical and/or thoracic vertebrae of a human, the method comprising sleeping with the head and neck supported by a pillow designed to improve curvature and/or alignment of the cervical and/or thoracic vertebrae;

1.2. A method according to Method 1, wherein said pillow comprises a foam body and a first forward region of convex curvature, a second middle region of concave curvature, and a third rear region of convex curvature;

1.3. A method according to Method 1, wherein said pillow comprises a stepped configuration in which the front portion of the pillow is of greater height than the rear portion of the pillow;

1.4. A method according to Method 1, wherein said pillow comprises three adjacent sections, a middle back-sleeper section with two adjacent outer side-sleeper sections, wherein each section comprises a first forward region of convex curvature, a second middle region of concave curvature, and a third rear region of convex curvature, and wherein the outer side-sleeper sections are of greater thickness than the middle back-sleep section;

1.5. A method according to Method 1 or any of methods 1.1-1.4, of maintaining or improving the curvature and/or alignment of the cervical and/or thoracic vertebrae of a human, the method comprising sleeping with the head and neck supported by a pillow comprising:

a foam body having a top surface, an opposing bottom surface, a rear edge and an opposing front edge and lateral sides, wherein the foam body is defined by a first region that includes the front edge, a second region adjacent the first region and a third region adjacent the second region and defining the rear edge, wherein the first region has a convex shape, the second region has a concave shape and the third region has a convex shape, the pillow having a maximum thickness in the first region and a minimum thickness in the second region, the first region having a first section that extends to the front edge and has a positive slope and an adjacent second section that has a negative slope and extends to the second region, wherein the front edge has a height greater than the rear edge; and a plurality of ribs extending longitudinally between the lateral side and being located exclusively within the first section of the first region which has positive slope, the second section of the first region which has negative slope being free of ribs;

and optionally a means of altering the height of thickness of the pillow (e.g. a pocket disposed along the bottom surface and open along one or more edges and sized to enable insertion of foam inserts to raise the height of the pillow);

1.6. Method 1 or any of 1.1-1.5, wherein the human is a patient suffering from an ailment of the spine, neck or cervical vertebrae (e.g., a misalignment of the cervical vertebrae);

1.7. Method 1.6, wherein the method is effective for treating or ameliorating one or more ailments including, but not limited to: misalignment of the cervical vertebrae, chronic or acute neck pain, chronic or acute back pain, chronic or acute shoulder pain, muscle spasms, headache, numbness of the extremities, excessive abnormal curvature of the cervical or thoracic vertebrae (e.g., kyphosis or lordosis), cervical or lumbar arthritis, or disorders of the intervertebral discs (e.g., disc inflammation, disc prolapse, disc herniation), and symptoms associated with heart or respiratory disorders (e.g., COPD);

1.8. Method 1.6, wherein the patient is diagnosed as having an abnormal alignment or curvature of the cervical or thoracic vertebrae (e.g., diagnosed by X-ray radiography);

1.9. Method 1 or any of 1.1-1.8, further comprising the step of sleeping on the pillow for a period of time from about 2 hours to about 10 hours per night (e.g., 6 to 8 hours), on a regular basis (e.g., every night or five nights per week);

1.10. Method 1 or any of 1.1-1.9, wherein the foam body is formed of viscoelastic foam, whereby a head and neck of a user arches back over the first region as supported by the foam body when the user is in a supine position with the head being at least substantially contained in the second region;

1.11. Method 1 or any of 1.1-1.10, wherein each rib comprises a rounded rib;

1.12. Method 1.11, wherein the rounded rib has a convex shape;

1.13. Method 1 or any of 1.1-1.12, wherein the ribs extend along the entire length of the foam body from one lateral side to the other lateral side;

1.14. Method 1 or any of 1.1-1.13, wherein the plurality of ribs comprises from two to six ribs, for example, three ribs, namely, a front rib, a middle rib and a rear rib, with a first distance being defined between the front rib and middle rib and a second distance being defined between the middle rib and the rear rib, as measured along a width of the foam pillow;

1.15. Method 1 or any of 1.1-1.14, wherein the first region is defined by a first radius of curvature and a second region is defined by a second radius of curvature, and the third region is defined by a third radius of curvature, the third radius of curvature being greater than the first radius of curvature;

1.16. Method 1 or any of 1.1-1.15, wherein the plurality of ribs have convex shapes with a radius of curvature that defines each rib being at least substantially equal;

1.17. Method 1 or any of 1.11-1.16, wherein the first radius of curvature is about 3.944 inches; the second radius of curvature is about 3.927 inches and the third radius of curvature is about 6.693 inches;

1.18. Method 1 or any of 1.1-1.17, wherein the front rib defines a forward-most point of the foam body;

1.19. Method 1 or any of 1.1-1.18, wherein the second section has a step configuration;

1.20. Method 1.19, wherein the second section includes a pair of steps located between first and second planar portions that are located at the front edge and rear edge, respectively, of the pillow;

1.21. Method 1.20, wherein the first and second planar portions are parallel to one another;

1.22. Method 1.20, wherein the pair of steps includes a first step having a first slope and a second step having a second slope, the first slope being greater than the second slope and located closer to the rear edge;

1.23. Method 1.22, wherein a length of the second step is greater than a length of the first step;

1.24. A method according to Method 1 or any of 1.1-1.4, of maintaining or improving the curvature and/or alignment of the cervical and/or thoracic vertebrae of a human, the method comprising sleeping with the head and neck supported by a pillow comprising:

a foam body having a top surface, an opposing bottom surface, a front edge, a rear edge and an opposing front edge and lateral sides extending between the rear and front edges, wherein the foam body is defined by a first (middle) section constructed for use when a user is in the supine sleeping position and a pair of adjacent second (outer) sections for use when the user in the side-lying position, the first section being disposed between the second sections;

wherein the first section includes:

a first region that includes the front edge, a second region adjacent the first region and a third region adjacent the second region and defining the rear edge, wherein the first region has a convex shape, the second region has a concave shape and the third region has a convex shape, the first region having a first section that extends to the front edge and has a positive slope and an adjacent second section that has a negative slope and extends to the second region, wherein the front edge has a height greater than the rear edge; and a plurality of ribs extending longitudinally between the lateral side and being located exclusively within the first section of the first region which has positive slope, the second section of the first region which has negative slope being free of ribs; and wherein the second section includes a pair of arcuate shaped cut-outs formed in the front edge, the arcuate shaped cut-outs being spaced apart along the front edge for receiving a shoulder of a user in the side-lying position; and optionally a means of altering the height of thickness of the pillow (e.g. a pocket disposed along the bottom surface and open along one or more edges and sized to enable insertion of foam inserts to raise the height of the pillow);

1.25. Method 1.24, wherein the human is a patient suffering from an ailment of the spine, neck or cervical vertebrae (e.g., a misalignment of the cervical vertebrae);

1.26. Method 1.25, wherein the method is effective for treating or ameliorating one or more ailments including but not limited to: misalignment of the cervical vertebrae, chronic or acute neck pain, chronic or acute back pain, chronic or acute shoulder pain, muscle spasms, headache, numbness of the extremities, excessive abnormal curvature of the cervical or thoracic vertebrae (e.g., kyphosis or lordosis), cervical or lumbar arthritis, or disorders of the intervertebral discs (e.g., disc inflammation, disc prolapse, disc herniation), and symptoms associated with heart or respiratory disorders (e.g., COPD);

1.27. Method 1 or any of 1.20-1.26, wherein the patient is diagnosed as having an abnormal alignment or curvature of the cervical or thoracic vertebrae (e.g., diagnosed by X-ray radiography);

1.28. Method 1 or any of 1.20-1.27, further comprising the step of sleeping on the pillow for a period of time from about 2 hours to about 10 hours per night (e.g., 6 to 8 hours), on a regular basis (e.g., every night or five nights per week);

1.29. Method 1 or any of 1.20-1.28, wherein the foam body is formed of viscoelastic foam, whereby a head and neck of a user arches back over the first region as supported by the foam body when the user is in a supine position with the head being at least substantially contained in the second region;

1.30. Method 1.29, wherein each rib comprises a rounded rib;

1.31. Method 1 or any of 1.20-1.30, wherein the plurality of ribs comprises from one to six ribs, for example, three ribs, namely, a front rib, a middle rib and a rear rib, with a first distance being defined between the front rib and middle rib and a second distance being defined between the middle rib and the rear rib, as measured along a width of the foam pillow;

1.32. Method 1 or any of 1.20-1.31, wherein the plurality of ribs have convex shapes with a radius of curvature that defines each rib being at least substantially equal;

1.33. Method 1 or any of 1.20-1.32, wherein an inner beveled wall is formed at an interface between the first section and each second section, each inner beveled wall being angled in a lateral direction toward the respective second section which defines one respective lateral side, the inner beveled wall having a varying height as measured from the rear edge to the front edge;

1.34. Method 1 or any of 1.1-1.33, wherein the patient has reversed (kyphotic) curvature of the cervical vertebrae, e.g., a negative curvature, and wherein use of a pillow according to the method results in the patient's cervical spine attaining lordotic curvature (e.g., positive curvature), for example, normal curvature (+17 to +24 cm degrees of arc).

As used herein, the term "alignment" refers to both the curvature of the cervical or thoracic vertebrae as viewed from the side, or the alignment of the cervical or thoracic vertebrae as viewed from the front or back. As used herein, "abnormal alignment" refers to abnormal curvature of the cervical spine (e.g., outside of the normal lordotic range), abnormal alignment of the spinal processes of the vertebra (where the vertebrae are not aligned substantially along the midline of the spine), or any other deviation of the orientation of the cervical or thoracic vertebrae, with respect to each other or to the rest of the body, that is considered abnormal.

The invention is described in detail with reference to particular embodiments thereof, but the scope of the invention is to be gauged by the claims that follow and also by those modifications that provide equivalent features to those that are claimed as such modifications are still within the spirit and scope of the invention.

EXAMPLES

X-ray radiographic studies are conducted to compare the effects of pillows of the present disclosure versus standard polyester-filled pillow, or other commercial pillows, on the curvature or alignment of the cervical spine of patient presenting with hypo-lordosis. The normal lordotic curvature of the cervical spine is +17 to +24 centimeters degree of arc, with curvature being concave when viewed from the side, with respect to the line formed between the occiput and the sacrum. Normal alignment of the spine consists of the spinous process of each cervical vertebra forming a substantially straight line when viewed from the back, and in each spinous process being positioned approximately at the midpoint of the spine. Patients are first assessed in a standing position, followed by assessment in the supine position using various types of pillows.

Example 1

Cervical Curvature

Multiple patients presenting with abnormal cervical curvature (Cases 1-4) are assessed using the pillow 200 versus one or more pillows, including standard down-filled pillows, contoured polyester-filled pillows, commercial therapeutic interlocking-fill pillows or commercial contoured memory foam pillows. Standing curvatures range from −130 centimeter degrees (nearly straight) to −26 centimeter degrees (strongly convex). Upon lying supine on conventional pillows, the patients' abnormal cervical curvatures are either only slightly improved or worsened. In contrast, when lying supine on a Pillow 200 of the present disclosure, all patients showed markedly improved curvature of the cervical spine (curvature became positive, i.e. lordotic, for each patient).

Results are shown in Table 1 below (curvature measured in centimeters degree of arc):

TABLE 1

| Case | Curvature Standing | Curvature on Conventional Pillow | Curvature on Pillow of the Disclosure |
|---|---|---|---|
| 1 | −68 | −150[b] | +26 |
| 2 | −26 | −66[a] | +30 |
| 3A | −130 | −130[c] | +28 |
| 3B | | +50[d] | |
| 4 | −130 | −55[a] | +24 |

TABLE 1-continued

| Case | Curvature Standing | Curvature on Conventional Pillow | Curvature on Pillow of the Disclosure |
|---|---|---|---|
| 5 | +17 | +500[c] | +21 |
| 6A | +20 | +43[d] | +21 |
| 6B | | +100[b] | |
| | Normal Curvature Range: +17 to +24 | | |

Conventional pillow types:
[a]standard down-filled pillow
[b]contoured polyester-filled pillow
[c]therapeutic interlocking-fill pillow
[d]contoured memory foam pillow FIGS. 28A to 28C show the corresponding X-ray images for case study 1. In FIG. 28-A, the patient is imaged standing. The dashed line A marks normal lordotic curvature (+17 to +24 centimeter degree arc), while line B traces the actual curvature of the patient's spine (−68 cm degree), which is reversed (also known as kyphotic). In FIG. 28-B, the patient is imaged lying supine on a Pillow 200 of the present disclosure. Dashed line A shows normal curvature, while solid line B shows the patient's curvature. The patient's curvature is shown to be +26 cm degrees, which, while just outside the normal range of lordotic curvature, is significantly improved from the patient's standing baseline. In contrast, as shown in FIG. 28-C, when the patient lies supine on a contoured polyester-filled pillow, the patient's cervical curvature (line B) remains highly abnormal (−150 degrees of curvature, still kyphotic) compared to normal curvature (line A).

Table 1 shows similar results for patients 2, 3 and 4. Patient 2, who began with even worse kyphotic curvature than patient 1 (−26 cm degrees), improves only slightly when lying supine on a standard down pillow (−66 cm degrees, still kyphotic), but achieves nearly normal lordotic curvature on a Pillow 200 (+30 cm degrees). Likewise, patient 3 has nearly straight curvature standing (−130 cm degrees) and improves to almost normal lordotic curvature using Pillow 200 (+28 cm degrees). In contrast, on a therapeutic interlocking-fill pillow, this patient shows no change from standing, while on a commercial contoured memory foam pillow, this patient shows a very shallow lordotic curvature (+50 cm degrees). Patient 4, also with nearly straight standing curvature (−130 cm degrees), improves to within the normal lordotic range using Pillow 200 (+24 cm degrees), but becomes even more kyphotic on a standard down pillow (−55 cm degrees). These studies demonstrate the effectiveness of the pillows of the present disclosure in reversing abnormal curvature of the cervical spine during sleep.

Also shown in Table 1 are the results from two patients who have cervical curvatures within the normal range (patients 5 and 6). FIG. 29-A shows patient 5's standing curvature of +17 cm degrees of arc (solid line B). When lying on a Pillow 200 of the present disclosure, the patient's cervical curvature remains substantially the same (+21 cm degrees of arc, still within the normal range), as shown in FIG. 29-B (solid line B). In contrast, as shown in FIG. 29-C, when lying on a commercial therapeutic interlocking-fill pillow, which lacks the kind of support provided by Pillow 200, it is observed that the patient's neck becomes substantially straight (+500 cm degrees of arc, solid line B). This curvature is well outside the normal lordotic range (line A in each figure), and could result in significant adverse effects. Similarly, patient 6 presents with +20 cm degrees of arc curvature while standing, and this remains substantially the same when lying supine on Pillow 200 (+21 cm degrees). In contrast, this patient's neck loses curvature (straightens) on both a contoured polyester pillow (+100 cm degrees) and on a contoured memory foam pillow (+43 cm degrees). These examples demonstrate the efficacy of the pillows of the present disclosure in maintaining healthy curvature of the neck during sleep in persons considered to have normal neck curvature.

Example 2

Thoracic Alignment

Patient 6 is assessed using the pillow 600 versus a commercial contoured memory foam pillow. FIG. 30-A shows the patient's standing cervical alignment. The solid lines mark the edges of the patient's spinal column, and dotted line A marks the midpoint line. Ideally, the tip of each spinous process (white carets) should be located on or substantially close to the midpoint line. While most of the patient's spinous processes show proper alignment, the spinous process of vertebra T3 (marked C) is out of alignment (it is greater than 2.5 centimeters from the midpoint line). In FIG. 30-B, patient 6 is shown side-lying on the Pillow 600 of the present disclosure. Lying on this pillow causes the patient's deviant T3 vertebra (white caret B) to become properly aligned along the midline of the spine (dashed line A). In contrast, lying on the commercial contoured memory foam pillow, the patient's T3 vertebra (black caret C) remains out of alignment, and in addition, several more vertebrae also fall out of alignment with the spinal midpoint line (dashed line A). On this pillow, only the C5 and C6 vertebrae are in proper alignment, while the C7 and T1-4 vertebrae are all misaligned (black carets). This study demonstrates that the side-lying pillow 600 is effective at correcting spinal misalignment, and that a commercial contoured memory foam pillow actually can cause increased misalignment of the spine during sleep.

What is claimed:

1. A pillow comprising:

a foam body having a top surface, an opposing bottom surface, a rear edge and an opposing front edge and lateral sides, wherein the foam body is defined by a first segment constructed for use when a user is in a supine sleeping position and a pair of adjacent second segments for use when the user is in a side-lying position, the first segment being disposed between the second segments;

wherein the first segment has a uniform cross-sectional form and includes:

a first region that includes the front edge, a second region adjacent the first region and a third region adjacent the second region and defining the rear edge, wherein the first region has a convex shape, the second region has a concave shape and the third region has a convex shape, the first region having a first section that extends to the front edge and has a positive slope and an adjacent second section that has a negative slope and extends to the second region, wherein the front edge has a height greater than the rear edge; and a plurality of ribs extending longitudinally between the lateral sides and being located exclusively within the first section of the first region which has positive slope, the second section of the first region which has negative slope being free of ribs; and wherein each second segment includes an arcuate shaped cut-out formed in the front edge, the arcuate shaped cut-outs being spaced apart along the front edge for receiving a shoulder of a user in the side-lying position;

and wherein the each second segment has a step configuration comprising a pair of steps located between first and second planar portions that are located at the front edge and rear edge, respectively, of the pillow, wherein the first and second planar portions are parallel to one another.

2. The pillow of claim 1, wherein the foam body is formed of a viscoelastic foam, whereby a head and neck of a user arches back over the first region when the user is lying on the pillow in the supine position with the head being at least substantially contained in the second region.

3. The pillow of claim 1, wherein the plurality of ribs consists of three ribs, namely, a front rib, a middle rib and a rear rib, with a first distance being defined between the front rib and middle rib and a second distance being defined between the middle rib and the rear rib, as measured along a width of the foam pillow.

4. The pillow of claim 1, wherein the plurality of ribs have convex shapes with a radius of curvature that defines each rib being at least substantially equal.

5. The pillow of claim 1, wherein an inner beveled wall is formed at an interface between the first segment and each second segment, each inner beveled wall being angled in a lateral direction toward each respective second segment which defines one respective lateral side, the inner beveled wall having a varying height as measured from the rear edge to the front edge.

6. The pillow of claim 1, wherein the pair of steps includes a first step having a first slope and a second step having a second slope, the first slope being greater than the second slope and located closer to the rear edge.

7. The pillow of claim 6, wherein a length of the second step is greater than a length of the first step.

* * * * *